US008261704B2

(12) United States Patent
Takemura

(10) Patent No.: US 8,261,704 B2
(45) Date of Patent: Sep. 11, 2012

(54) VARIABLE VALVE TIMING CONTROL APPARATUS FOR INTERNAL COMBUSTION ENGINE

(75) Inventor: Yuichi Takemura, Toyohashi (JP)

(73) Assignee: Denso Corporation, Kariya (JP)

( * ) Notice: Subject to any disclaimer, the term of this patent is extended or adjusted under 35 U.S.C. 154(b) by 252 days.

(21) Appl. No.: 12/839,602

(22) Filed: Jul. 20, 2010

(65) Prior Publication Data

US 2011/0023805 A1 Feb. 3, 2011

(30) Foreign Application Priority Data

Jul. 30, 2009 (JP) ..... 2009-178291

(51) Int. Cl.
*F01L 1/34* (2006.01)

(52) U.S. Cl. ..... 123/90.15; 123/90.17; 464/160

(58) Field of Classification Search ..... 123/90.15, 123/90.17; 464/160
See application file for complete search history.

(56) References Cited

U.S. PATENT DOCUMENTS 5,738,056 A 4/1998 Mikame et al.
6,330,870 B1 12/2001 Inoue et al.
6,505,586 B1 1/2003 Sato et al.
6,684,837 B2 2/2004 Miyakoshi
7,444,964 B2 11/2008 Kanada et al.
7,565,889 B2 * 7/2009 Iwata et al. ..... 123/90.17

FOREIGN PATENT DOCUMENTS

JP 9-195805 7/1997
JP 2001-234768 8/2001
JP P2005-264764 A 9/2005

OTHER PUBLICATIONS

Japanese Office Action dated Jun. 29, 2012, issued in corresponding Japanese Application No. 2009-178291, with English translation.

* cited by examiner

*Primary Examiner* — Ching Chang
(74) *Attorney, Agent, or Firm* — Nixon & Vanderhye PC

(57) ABSTRACT

A variable valve timing control apparatus is provided for an internal combustion engine that has a crankshaft, a camshaft, a hydraulic variable valve timing unit, a lock pin, and a hydraulic control valve. The hydraulic control valve is configured to control oil pressure that actuates the variable valve timing unit and the lock pin. The control apparatus switches a control, based on an operational state, between (a) a variable cam timing (VCT) phase control for controlling the VCT phase to a target phase and (b) a lock pin projection control for allowing the lock pin to project. The control apparatus executes, when an abnormality occurs, a foreign object release control for changing a control amount of the hydraulic control valve based on a predetermined pattern, wherein the control apparatus changes the predetermined pattern depending on the abnormality in the execution of the foreign object release control.

28 Claims, 15 Drawing Sheets

VARIABLE VALVE TIMING CONTROL APPARATUS FOR INTERNAL COMBUSTION ENGINE

CROSS REFERENCE TO RELATED APPLICATION

This application is based on and incorporates herein by reference Japanese Patent Application No. 2009-178291 filed on Jul. 30, 2009.

BACKGROUND OF THE INVENTION

1. Field of the Invention

The invention is related to a variable valve timing control apparatus for an internal combustion engine having a camshaft and a crankshaft, and the variable valve timing control apparatus is provided with an intermediate lock mechanism. The intermediate lock mechanism locks a VCT phase that is a rotational phase of the camshaft relative to the crankshaft at an intermediate lock position located within an adjustable range of the VCT phase.

2. Description of Related Art

In a conventional hydraulic variable valve timing unit, as described in JP-A-H9-324613 corresponding to U.S. Pat. No. 5,738,056 and JP-A-2001-159330 corresponding to U.S. Pat. No. 6,330,870, a lock position during the engine stop is designed to be located at a middle of an adjustable range of a variable cam timing (VCT) phase such that the adjustable range of the valve timing (VCT phase) is enlarged. In the above, the intermediate lock position, at which the VCT phase is locked during the stop of the engine, is set at a position suitable for the engine start. Thus, the engine is started while the VCT phase is at the intermediate lock position, and when the engine rotation (oil pump rotation) has increased after the starting of the engine is completed, and thereby the oil pressure has reached an appropriate oil pressure, the lock is released such that the VCT phase is controlled to a target VCT phase that is determined based on the engine operational state.

A hydraulic control valve controls oil pressure that actuates the variable valve timing unit. The hydraulic control valve may be abnormally operates when foreign objects are clogged in the valve element. For example, the foreign objects may be impurities, in oil that circulates in the hydraulic control valve. As a result, for example, the following abnormalities may occur, a lock abnormality, in which the VCT phase is not locked as required, a lock release abnormality, in which the lock of the VCT phase is not released as required, a VCT phase control abnormality, in which the VCT phase is not controlled to the target phase as required.

For example, as described in JP-A-H9-195805 and JP-A-2001-234768, upon the generation of a foreign-object-release request (cleaning request), a control amount (control duty) of the hydraulic control valve is alternately changed at predetermined intervals of time between a minimum value (0%) and a maximum value (100%) such that the clogged foreign objects are removed.

However, in a certain configuration of the hydraulic control valve, when the control amount (control duty) of the hydraulic control valve is alternately changed at predetermined periods of time between a minimum value (0%) and a maximum value (100%) upon the generation of the foreign-object-release request, the lock pin may periodically project and retract, and thereby the lock pin repeatedly may collide with a wall surface that defines the lock hole. As a result, abnormal noise may be generated, and the components may deteriorate disadvantageously.

SUMMARY OF THE INVENTION

The present invention is made in view of the above disadvantages. Thus, it is an objective of the present invention to address at least one of the above disadvantages.

To achieve the objective of the present invention, there is provided a variable valve timing control apparatus for an internal combustion engine that has a crankshaft, a camshaft, a hydraulic variable valve timing unit, a lock pin, and a hydraulic control valve. The hydraulic variable valve timing unit is configured to adjust valve timing by changing a variable cam timing (VCT) phase that is a rotational phase of the camshaft relative to the crankshaft. The lock pin is configured to lock the VCT phase at an intermediate lock position located within an adjustable range of the VCT phase. The hydraulic control valve is configured to control oil pressure that actuates the variable valve timing unit and the lock pin. The variable valve timing control apparatus includes VCT control means and foreign object release control means. The VCT control means switches a control, based on an operational state, between (a) a VCT phase control for controlling the VCT phase to a target phase and (b) a lock pin projection control for allowing the lock pin to project. The foreign object release control means executes, when an abnormality occurs, a foreign object release control for changing a control amount of the hydraulic control valve based on a predetermined pattern, wherein the foreign object release control means changes the predetermined pattern depending on the abnormality in the execution of the foreign object release control.

To achieve the objective of the present invention, there is also provided a variable valve timing control apparatus for an internal combustion engine that has a crankshaft, a camshaft, a hydraulic variable valve timing unit, a lock pin, and a hydraulic control valve. The hydraulic variable valve timing unit is configured to adjust valve timing by changing a variable cam timing (VCT) phase that is a rotational phase of the camshaft relative to the crankshaft. The lock pin is configured to lock the VCT phase at an intermediate lock position located within an adjustable range of the VCT phase. The hydraulic control valve is configured to control oil pressure that actuates the variable valve timing unit and the lock pin. The variable valve timing control apparatus includes VCT control means and foreign object release control means. The VCT control means switches a control, based on an operational state, between (a) a VCT phase control for controlling the VCT phase to a target phase and (b) a lock pin projection control for allowing the lock pin to project. The foreign object release control means executes, when an abnormality occurs, a foreign object release control for changing a control amount of the hydraulic control valve based on a predetermined pattern, wherein the VCT control means executes, upon generation of a lock request, a lock trial control, in which the VCT phase is temporarily shifted in a first direction to pass the intermediate lock position by a predetermined passing amount and then the VCT control means executes the lock pin projection control in order to lock the VCT phase by the lock pin while the VCT phase is shifted in a second direction opposite from the first direction back to the intermediate lock position. When the lock of the VCT phase has not been completed after the lock pin projection control has been executed for a predetermined period, the predetermined passing amount is adjusted, and the lock trial control is repeated until the lock is completed. When the lock of the VCT phase has not been completed even after a number of times of executing the lock trial control reaches a predetermined number of times, the foreign object release control means determines that the abnormality of a lock occurs and executes the foreign object release control.

To achieve the objective of the present invention, there is also provided a variable valve timing control apparatus for an internal combustion engine that has a crankshaft, a camshaft, a hydraulic variable valve timing unit, a lock pin, and a hydraulic control valve. The hydraulic variable valve timing unit is configured to adjust valve timing by changing a variable cam timing (VCT) phase that is a rotational phase of the camshaft relative to the crankshaft. The lock pin is configured to lock the VCT phase at an intermediate lock position located within an adjustable range of the VCT phase. The hydraulic control valve is configured to control oil pressure that actuates the variable valve timing unit and the lock pin. The variable valve timing control apparatus includes VCT control means and foreign object release control means. The VCT control means switches a control, based on an operational state, between (a) a VCT phase control for controlling the VCT phase to a target phase and (b) a lock pin projection control for allowing the lock pin to project. The foreign object release control means executes, when an abnormality occurs, a foreign object release control for changing a control amount of the hydraulic control valve based on a predetermined pattern, wherein the VCT control means executes a lock release control when a lock release request is generated. The lock release control includes a pin retraction control and the VCT phase control. In the pin retraction control, the lock pin is retracted in a lock release direction while a driving force for shifting the VCT phase in an advance direction or in a retard direction is regulated to be equal to or less than a predetermined value. The VCT phase control is executed after the pin retraction control has been executed for a predetermined period. The VCT control means further executes the lock release control once or more when the VCT phase has not been shifted from the intermediate lock position after the VCT phase control has been executed for a predetermined period. The foreign object release control means determines that the abnormality of a lock release occurs and executes the foreign object release control when the VCT phase has still not been shifted from the intermediate lock position even after the further execution of the lock release control.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

One embodiment of the present invention will be described with reference to accompanying drawings.

Figure 1:
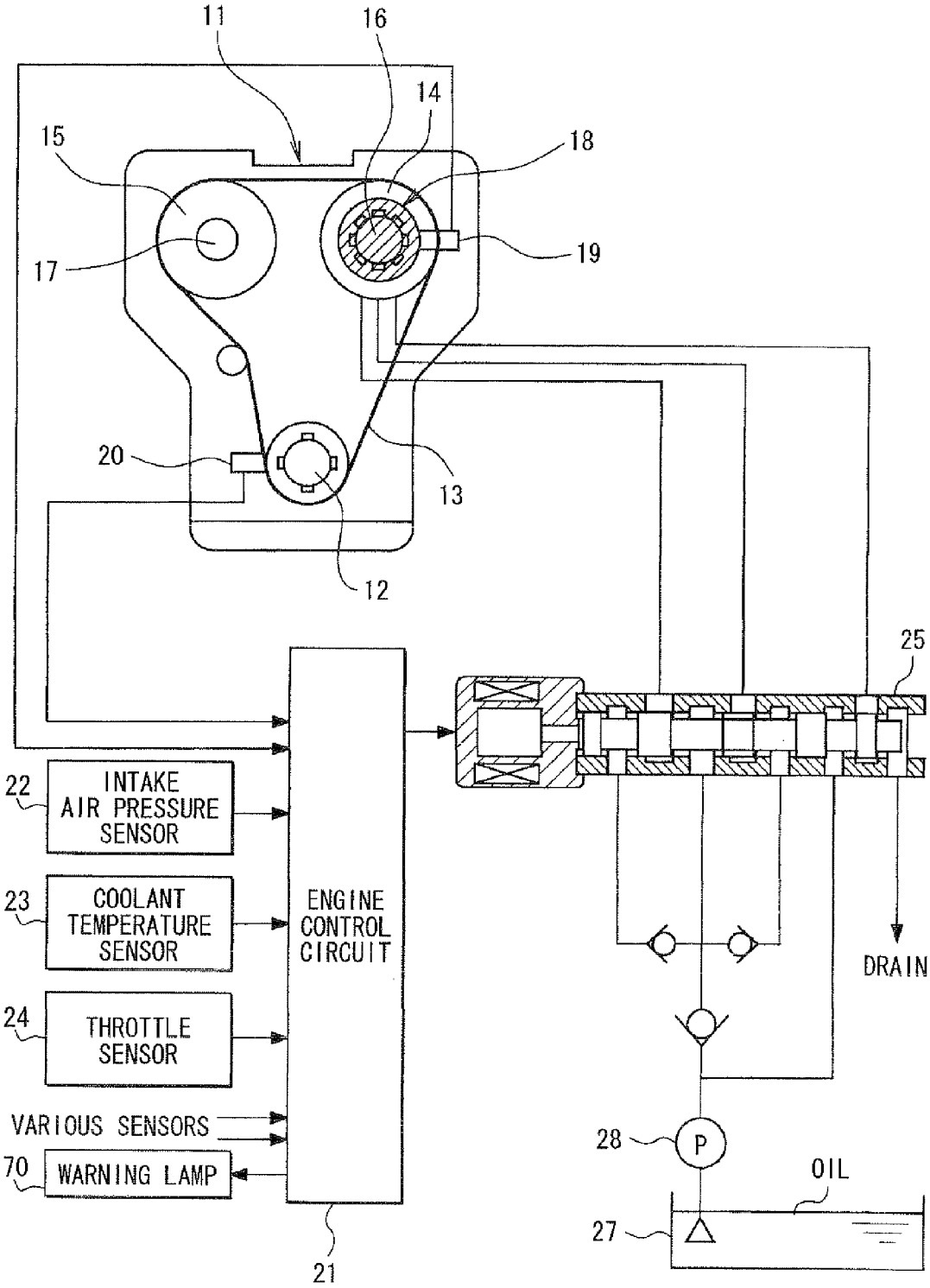
FIG. 1 is a schematic configuration generally illustrating an engine control system used in one embodiment of the present invention.

As shown in FIG. 1, an engine 11 (internal combustion engine) transmits drive force from a crankshaft 12 to an intake camshaft 16 and an exhaust camshaft 17 through a timing chain 13 and sprockets 14, 15. The intake camshaft 16 is provided with a variable valve timing unit 18 (VCT technology) that adjusts an advance amount or a variable cam timing (VCT) phase of the intake camshaft 16 relative to the crankshaft 12. More specifically, the VCT phase is a rotational angular position of the intake camshaft 16 relative to a rotational angular position of the crankshaft 12.

Also, a cam angle sensor 19 is provided at a position radially outward of the intake camshaft 16 for outputting pulses of cam angle signals at predetermined cam angles. Also, a crank angle sensor 20 is provided at a position radially outward of the crankshaft 12 for outputting pulses of crank angle signals at predetermined crank angles. The signals outputted from the cam angle sensor 19 and the crank angle sensor 20 are fed to an engine control circuit 21. The engine control circuit 21 serves as VCT phase computing means and computes actual valve timing (actual VCT phase) of the intake valve based on a phase difference between the signal pulses outputted from the cam angle sensor 19 and the crank angle sensor 20. Also, the engine control circuit 21 computes an engine rotation speed based on a frequency (pulse interval) of the output pulses of the crank angle sensor 20. Furthermore, the other signals outputted by various sensors (an intake air pressure sensor 22, a coolant temperature sensor 23, a throttle sensor 24) for detecting an engine operational state are also fed to the engine control circuit 21.

The engine control circuit 21 executes fuel injection control and ignition control based on the engine operational state detected by the various sensors. Also, the engine control circuit 21 executes variable valve timing control (VCT phase feed-back control), in which the engine control circuit 21 feed-back controls oil pressure that actuates the variable valve timing unit 18 such that the actual valve timing (actual VCT phase) of the intake valve becomes target valve timing (target VCT phase) determined in accordance with an engine operational state.

Figure 2:
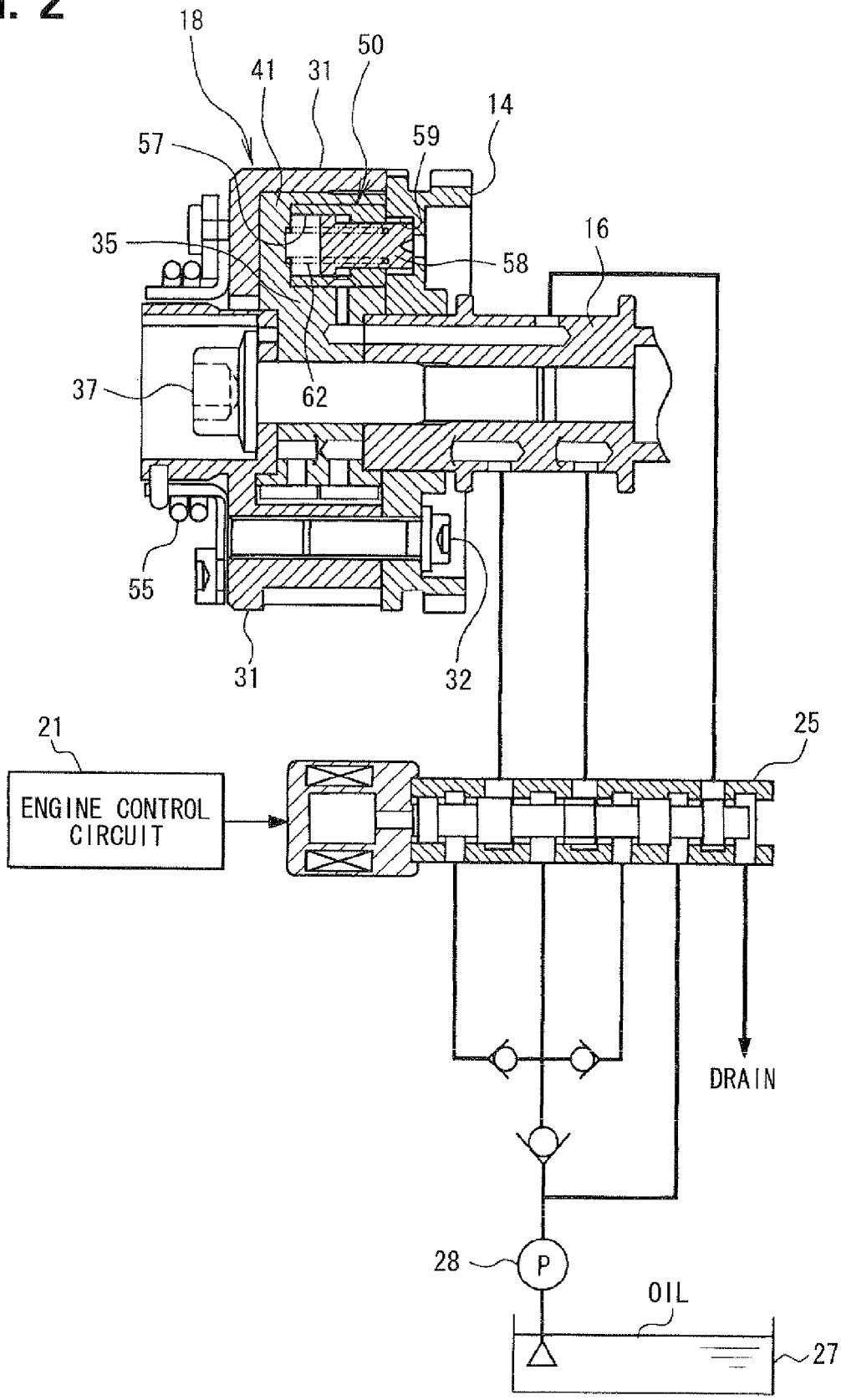
FIG. 2 is a sectional view of a variable valve timing unit and an oil pressure control circuit taken along a respective longitudinal axis of the variable valve timing unit and the oil pressure control circuit.

Next, the variable valve timing unit 18 will be described with reference to FIGS. 2 through 4.

The variable valve timing unit 18 has a housing 31 that is fixed to the sprocket 14 through a bolt 32. The sprocket 14 is movably supported at a position radially outward of the intake camshaft 16. Thus, when the rotation of the crankshaft 12 is transmitted to the sprocket 14 and the housing 31 through the timing chain 13, the sprocket 14 and the housing 31 are rotated synchronously with the crankshaft 12.

The intake camshaft 16 has one end portion that is fixed to a rotor 35 through a bolt 37. The rotor 35 is received within the housing 31 and is rotatable relative to the housing 31.

Figure 3:
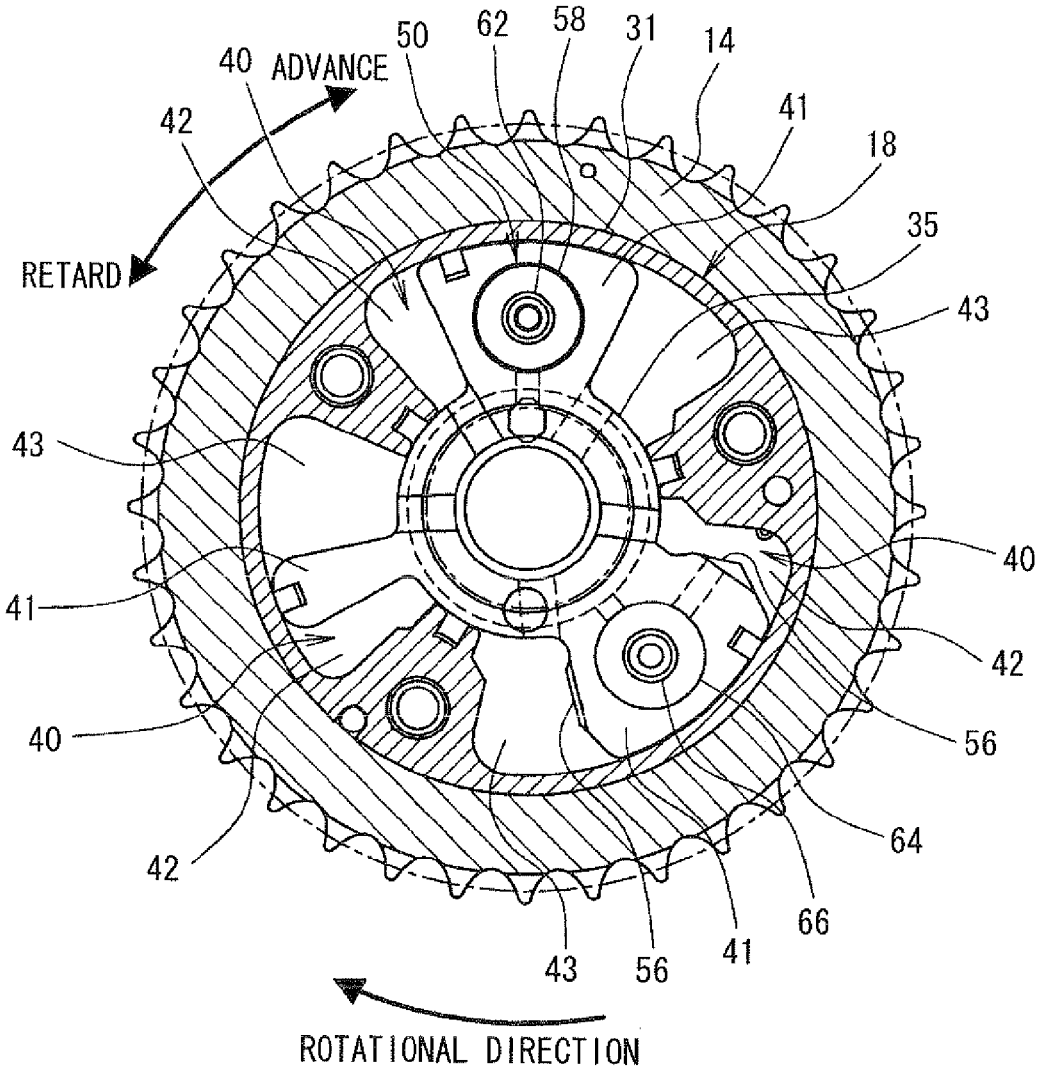
FIG. 3 is a sectional view of the variable valve timing unit taken along a plane perpendicular to the longitudinal axis of thereof.

As shown in FIG. 3, multiple vane receiving chambers 40 are formed within the housing 31, and vanes 41 are formed at radially outward parts of the rotor 35. Each of the vane receiving chambers 40 is divided into an advance chamber 42 and a retard chamber 43 by the corresponding vane 41. At least one of the vanes 41 has both circumferential ends that are provided with respective stoppers 56. Each of the stoppers 56 limits a rotational range of the rotor 35 (the vane 41) relative to the housing 31. The stoppers 56 defines a full retard position and a full advance position of an adjustable range of the actual VCT phase (camshaft phase).

The variable valve timing unit 18 is provided with an intermediate lock mechanism 50 that is adapted to lock the VCT phase at an intermediate lock position. For example, the intermediate lock position corresponds to a position or a phase between the full advance position and the full retard position (for example, a generally middle position) of the above adjustable range of the VCT phase. The intermediate lock mechanism 50 will be described below. A lock pin receiving hole 57 is provided to one of the multiple vanes 41. Alternatively, multiple lock pin receiving holes 57 may be provided to the multiple vanes 41, respectively. The lock pin receiving hole 57 receives therein a lock pin 58 that is displaceable to project from the lock pin receiving hole 57. The lock pin 58 locks the rotation of the rotor 35 (the vane 41) relative to the housing 31 when the lock pin 58 projects from the lock pin receiving hole 57 toward the sprocket 14 to be inserted into a lock hole 59 (see FIG. 4) of the sprocket 14. As a result, the VCT phase is locked at the intermediate lock position located generally in the middle of the adjustable range. The intermediate lock position is set at a phase that is suitable for starting the engine 11. It should be noted that the lock hole 59 may be alternatively provided to the housing 31.

Figure 4:
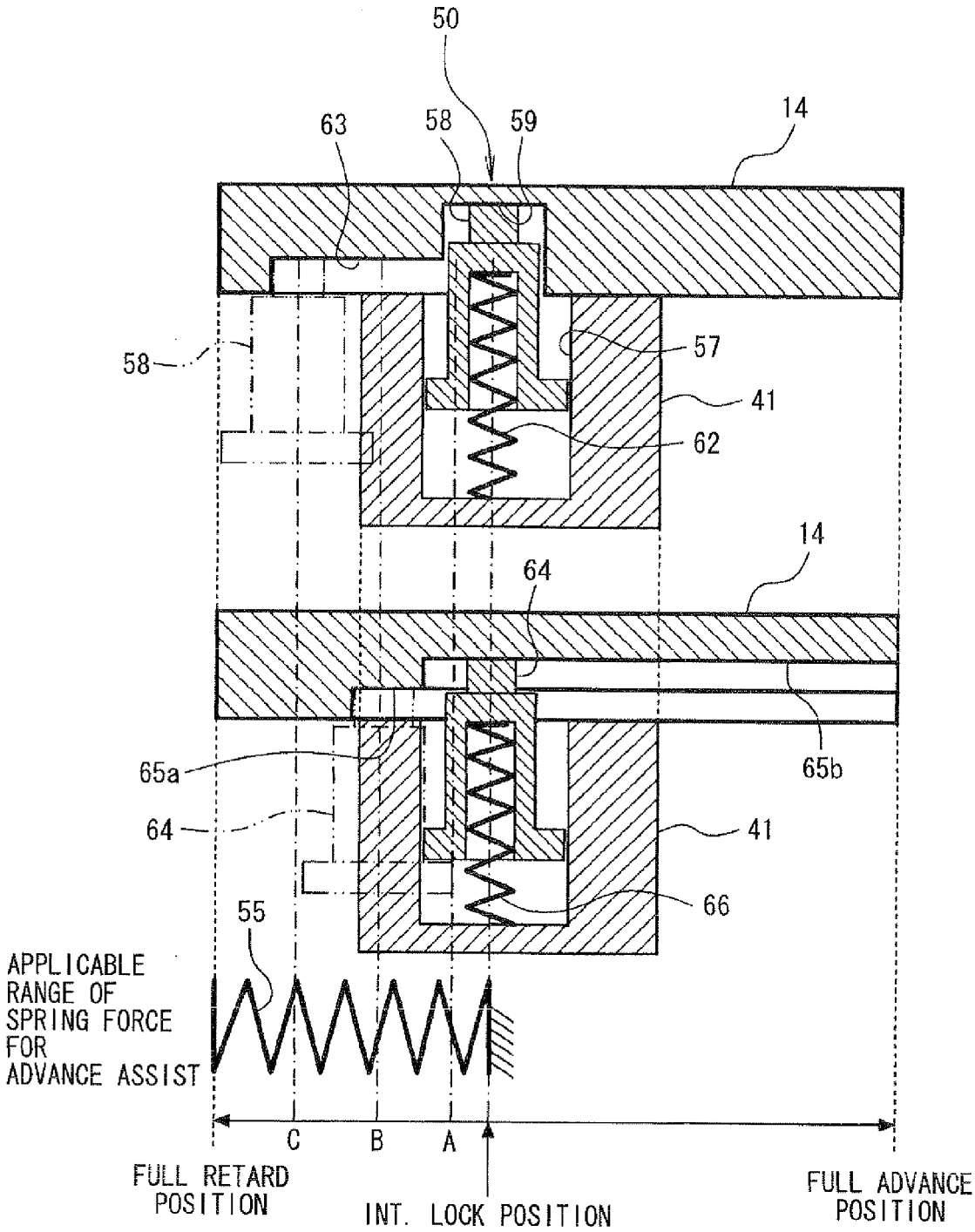
FIG. 4 is a diagram for explaining functions of a lock pin (advance limitation pin) and a retard limitation pin.

As shown in FIG. 4, the lock pin 58 is urged by a spring 62 in a lock direction for locking the VCT phase. In other words, the lock pin 58 is urged in a projection direction, in which the lock pin 58 is capable of projecting from the lock pin receiving hole 57. Also, an oil pressure chamber for releasing the lock is formed between (a) the radially outward part of the lock pin 58 and (b) the lock pin receiving hole 57. The oil pressure chamber is used to control oil pressure that actuates the lock pin 58 in a lock release direction for unlock the rotation of the rotor 35 to release the locked VCT phase. For example, when the pressure in the oil pressure chamber becomes high, the pressure urges the lock pin 58 in the lock release direction such that the lock pin 58 is displaced in the lock release direction against the urging force of the spring 62. Also, when the pressure in the oil pressure chamber becomes low, or is released, the pressure does not urge the lock pin 58 substantially. As a result, the lock pin 58 is urged only in the lock direction by the urging force of the spring 62, and thereby the lock pin 58 is displaced in the lock direction. In the present specification, the operation of urging the lock pin 58 in the lock direction indicates the state, where the pressure in the oil pressure chamber becomes low, and thereby the lock pin 58 is allowed to be displaced in the lock direction as described above.

In the present embodiment, the lock pin 58 serves as an advance limitation pin that prevents the VCT phase, which is controlled on a retard side of the intermediate lock position, from erroneously moving further in the advance direction to pass the intermediate lock position. An advance limitation groove 63 is formed continuously with the lock hole 59, and has a depth shallower than a depth of the lock hole 59. The advance limitation groove 63 extends to reach a predetermined position C that is close to a full retard position. Because of the engagement of the lock pin 58 (advance limitation pin) with the advance limitation groove 63, the VCT phase is controlled within a range between the intermediate lock position to the predetermined position C when the VCT phase is controlled on the retard side of the intermediate lock position.

When a target phase is set on a full-retard side of the predetermined position C, the lock pin 58 (advance limitation pin) is pulled out of (or is disengaged from) the advance limitation groove 63 by changing the oil pressure such that it is possible to shift the VCT phase further toward the full retard position from the predetermined position C. In contrast, when the target phase is set on an advance side of the intermediate lock position, oil pressure completely pulls the lock pin 58 (advance limitation pin) out of the lock hole 59 such that the VCT phase is enabled to be shifted in the advance direction from the intermediate lock position.

Similar to the above, there are formed a retard limitation pin 64 and two retard limitation grooves 65*a*, 65*b*. The retard limitation pin 64 prevents the VCT phase, which is to be controlled on an advance side of the predetermined position C, from being erroneously shifted in the retard direction. For example, the retard limitation grooves 65*a*, 65*b* are provided stepwise as shown in FIG. 4. When a spring 66 brings the retard limitation pin 64 into the engagement with one of the retard limitation grooves 65*a*, 65*b*, a controllable range of the VCT phase in the advance side of the predetermined position C is regulated in two steps, for example.

Alternatively, the two-step retard limitation grooves 65*a*, 65*b* may be replaced by a single retard limitation groove, and may be replaced by three step or more retard limitation grooves. Also, the advance limitation groove 63, the retard limitation grooves 65*a*, 65*b*, and the retard limitation pin 64 may be alternatively removed.

In a configuration example shown in FIG. 4, the retard limitation grooves 65*a*, 65*b* extend from the full advance position to predetermined positions B and A that are located on the retard side of the intermediate lock position. As a result, at the intermediate lock position, the lock pin 58 (advance limitation pin) and the retard limitation pin 64 are, respectively, engaged with or fitted into the lock hole 59 and the retard limitation groove 65*b*, which is the second step (deeper step) among the two grooves 65*a*, 65*b*.

It should be noted that the housing 31 is provided with a spring 55 (see FIG. 2) that provides spring force for assisting oil pressure applied to rotate the rotor 35 relatively in an advance direction during an advance control. The spring 55 may be a helical torsion spring and serves as urging means. In the variable valve timing unit 18 of the intake valve, torque of the intake camshaft 16 is applied in a direction for shifting the VCT phase in the retard direction. The above indicates that the spring 55 urges the rotor 35 to shift the VCT phase in the advance direction that is opposite from the direction of torque applied to the intake camshaft 16.

In the present embodiment, as shown in FIG. 4, it is designed such that the force of the spring 55 is applied to the rotor 35 in the advance direction when the VCT phase stays within a range from the full retard position to a position generally at the intermediate lock position. For example, the spring 55 is designed to work for a fail-safe operation during restarting the engine 11 after the engine 11 has abnormally stopped, such as an engine stall. More specifically, when the engine is started in a state, where the actual VCT phase is on a retard side of the intermediate lock position while the lock pin 58 is not fitted with the lock hole 59, the spring force of the spring 55 assists an advance operation, in which the actual VCT phase is advanced from the retard side toward the intermediate lock position such that the lock pin 58 is fitted into the lock hole 59 in order to lock the VCT phase, during the cranking by a starter (not shown).

In contrast, when the engine is started in another state, where the actual VCT phase is on an advance side of the intermediate lock position, torque of the intake camshaft 16 is applied in the retard direction during the cranking. As a result, the torque of the intake camshaft 16 retards the actual VCT phase from the advance side toward the intermediate lock position such that the lock pin 58 is engaged with the lock hole 59 for locking the VCT phase.

Figure 5:
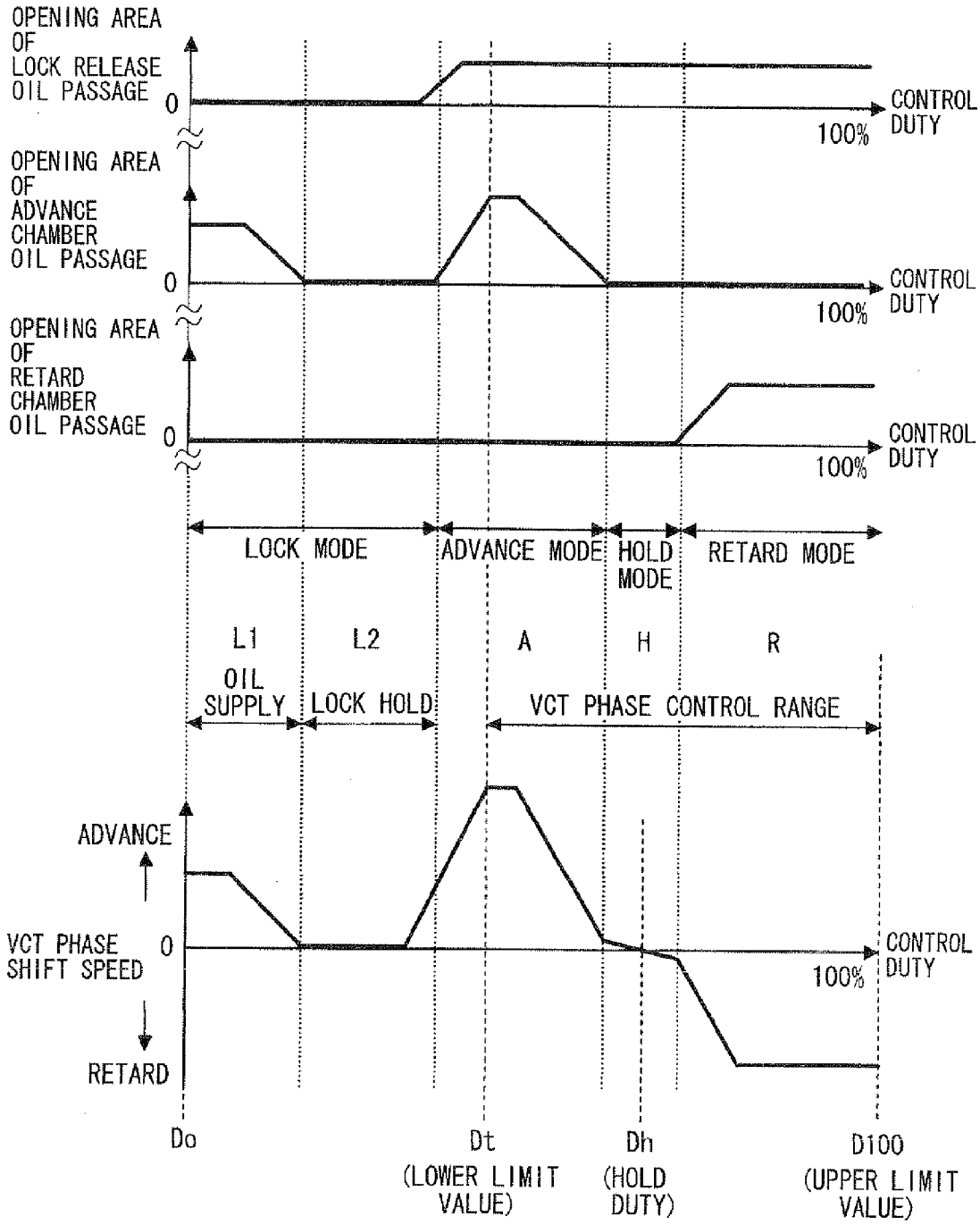
FIG. 5 is a diagram for explaining four control ranges of a control duty, which include a lock mode, an advance operation mode, a hold mode, and a retard operation mode.

Also, in the present embodiment, the hydraulic control valve controls oil pressure, which actuates the VCT phase of the variable valve timing unit 18, and which also actuates the lock pin 58 and the retard limitation pin 64. More specifically, the hydraulic control valve of the present embodiment integrally includes a hydraulic control valve 25 that has (a) first means for controlling oil pressure that actuates the VCT phase and (b) second means for controlling oil pressure that actuates the lock pin 58. For example, the first means functions as a phase-control hydraulic control valve, and the second means functions as a lock-control hydraulic control valve. Oil (hydraulic oil) in an oil pan 27 is pumped by an oil pump 28, which is driven by a drive force of the engine 11, and is supplied to the hydraulic control valve 25. The hydraulic control valve 25 includes, for example, an eight-port and four-position spool valve. As shown in FIG. 5, in accordance with a control range of a control duty (control amount) of the hydraulic control valve 25, the hydraulic control valve 25 is operated under four operation modes having a lock mode L1, L2, an advance operation mode A, a hold mode H, and a retard operation mode R. As above, because the single hydraulic control valve 25 integrally has the above two functions, it is possible to effectively reduce the number of components, and thereby reducing the cost of the system.

When the control duty is in the control range for the lock mode L1, L2, an oil supply passage for supplying oil to a lock-release oil pressure chamber within the lock pin receiving hole 57 is closed such that oil pressure in the lock-release oil pressure chamber within the lock pin receiving hole 57 is reduced. Thus, the lock pin 58 is allowed to project in the lock direction by the urging force of the spring 62.

Furthermore, the control range of the lock mode L1, L2 is divided into a control range of an oil supply mode L1 and a control range of a lock hold mode L2. When the control duty is in the control range of the oil supply mode L1, oil is supplied to the advance chambers 42 by allowing the lock pin 58 to be displaced in the lock direction and also by opening the oil supply passage to the advance chambers 42. Also, when the control duty is in the control range of the lock hold mode L2, oil pressures in the advance chambers 42 and the retard chambers 43 are maintained by allowing the lock pin 58 to be displaced in the lock direction and also by closing both of the oil supply passages to the advance chambers 42 and the retard chambers 43.

When the control duty is in the control range of the advance operation mode A, the actual VCT phase is advanced by the following manner. The oil supply passage to the retard chambers 43 is closed, and a retard port of the hydraulic control valve 25 is brought into communication with a drain port in order to reduce the oil pressure in the retard chambers 43. In the above state, the oil supply passages to the advance chambers 42 are opened in accordance with the control duty of the hydraulic control valve 25 to supply oil to the advance chambers 42. As a result, oil pressure in the advance chambers 42 are changed such that the actual VCT phase is advanced accordingly.

When the control duty is in the control range of the hold mode H, the actual VCT phase is maintained without moving by closing both of the oil supply passages to the advance chambers 42 and the retard chambers 43 such that oil pressures in both of the chambers 42, 43 are maintained.

When the control duty is in the control range of the retard operation mode R, the actual VCT phase is retarded in the following manner. Specifically, the oil supply passage to the advance chambers 42 is closed, and an advance port of the hydraulic control valve 25 is brought into communication with the drain port in order to reduce oil pressure in the advance chambers 42. In the above state, the oil supply passages to the retard chambers 43 are opened in accordance with the control duty of the hydraulic control valve 25 in order to supply oil to the retard chambers 43. As a result, oil pressure in the retard chambers 43 are changed such that the actual VCT phase is retarded accordingly.

When the control duty is in the control range other than the lock mode L1, L2 (or the control duty is in the control range for the advance operation mode A, the hold mode H, the retard operation mode R), the lock by the lock pin 58 is released in the following manner. For example, the oil supply passage to the lock-release oil pressure chamber in the lock pin receiving hole 57 is opened in order to supply oil to the lock-release oil pressure chamber. Thus, oil pressure in the lock-release oil pressure chamber is increased, and thereby the increased oil pressure causes the lock pin 58 to be pulled out of (or to be disengaged from) the lock hole 59 such that the lock by the lock pin 58 is released.

Note that, in the present embodiment, it is designed that the operation mode of the hydraulic control valve 25 is switched in the order of the lock mode L1, L2, the advance operation mode A, the hold mode H, and the retard operation mode R with the increase of the control duty of the hydraulic control valve 25. However, for example, the control mode may be alternatively switched in the order of the retard operation mode R, the hold mode H, the advance operation mode A, the lock mode L1, L2 with the increase of the control duty of the hydraulic control valve 25. Also, the control mode may be alternatively switched in the order of the lock mode L1. L2, the retard operation mode R, the hold mode H, the advance operation mode A with the increase of the control duty of the hydraulic control valve 25.

The engine control circuit 21 serves as VCT control means, and sets the target phase (target valve timing) in accordance with the engine operational condition during the VCT phase control (variable valve timing control) in order to FIB control pressure of oil supplied to the advance chambers 42 and the retard chambers 43 of the variable valve timing unit 18 based on the target phase. More specifically, the engine control circuit 21 FIB controls the control duty (control amount) of the hydraulic control valve 25 through, for example, PD control such that the actual VCT phase of the intake camshaft 16 (or actual valve timing of intake valve) becomes the target phase (target valve timing). In the above, "F/B" indicates the term "feed-back". The control range of the VCT phase control overlap with the control ranges of the retard operation mode R, the hold mode H, and the advance operation mode A as shown in FIG. 5.

Furthermore, the engine control circuit 21 executes a lock trial control upon the generation of a lock request when rotation of the engine 11 is to be stopped. More specifically, in the lock trial control, firstly, the VCT phase is temporarily shifted in a direction to pass the intermediate lock position by a predetermined passing amount such that the VCT phase reaches a position on the other side of the intermediate lock position before the shift. Secondly, the engine control circuit 21 shifts the VCT phase in the other direction toward the intermediate lock position while the engine control circuit 21 executes a lock pin projection control, in which the lock pin 58 is allowed to project in the lock direction. As above, in the lock trial control, the lock of the VCT phase by the lock pin 58 is tried or attempted. When it is not determined that the lock has been completed even after the lock pin projection control has been executed for a predetermined period of time, the predetermined passing amount, by which the VCT phase is shifted to pass the intermediate lock position in the lock trial control, is adjusted. Then, the lock trial control is executed again with the above adjusted amount. The lock trial control is repeatedly executed until it is determined that the lock has been completed. When the lock trial control is repeated by a predetermined number of times before it is determined that the lock has been completed, it is assumed that a lock abnormality, in which the VCT phase is not locked as required, occurs, and thereby a foreign object release control (described later) is executed.

Also, the engine control circuit 21 executes a lock release control upon the generation of a lock release request. More specifically, in the lock release control, a pin retraction control is firstly executed for a predetermined time period, and subsequently the VCT phase control is executed to control the VCT phase to the target phase. Typically, in the above pin retraction control, the control duty (control amount) of the hydraulic control valve 25 is regulated in a limited range, in which the driving force for shifting the VCT phase in the advance direction or in the retard direction is equal to or less than a predetermined value. Thus, while the control duty is regulated in the limited range as above, the lock pin 58 is actuated in the lock release direction to be retracted in the pin retraction control. When the VCT phase is not shifted from the intermediate lock position even after the VCT phase control has been executed for the predetermined time period since the execution of the pin retraction control, the lock release control (pin retraction control) is further executed once or more. When the VCT phase is not shifted from the intermediate lock position even after the further execution of the lock release control, it is assumed that a lock-release abnormality, in which the releasing of the lock of the VCT phase fails as above, occurs, and thereby the foreign object release control is executed subsequently.

Also, the engine control circuit 21 serves as foreign object release control means for changing a variable pattern (variable range) of the control duty of the hydraulic control valve 25 in accordance with the abnormality (or abnormal mode) when a foreign-object-release request is generated upon the detection of the abnormality.

Specifically, when the VCT phase has not been stabilized at the intermediate lock position even after a predetermined period has elapsed since the control is switched from the VCT phase control to the lock pin projection control, it is assumed that that the abnormality of the lock ("lock" abnormality) occurs, the foreign object release control is executed by setting a variable range of the control duty of the hydraulic control valve 25 such that the variable range of the control duty covers the control range of the VCT phase control and the control range of the lock mode. Also, when the lock pin 58 has not been retracted even after a predetermined period has elapsed since the control is switched from the lock pin projection control to a pin retraction control for retracting the lock pin 58, or when the VCT phase has not been stabilized at the target phase even after a predetermined period has elapsed since the control is switched from the lock pin projection control to the VCT phase control, it is assumed that the abnormality of a lock release ("lock-release" abnormality) occurs, and the foreign object release control is executed by setting the variable range of the control duty of the hydraulic control valve 25 such that the variable range of the control duty covers the control range of the lock mode and the control range of the VCT phase control. In the above, the control range of the VCT phase control generally corresponds to the range other than the control range of the lock mode (for example, the control ranges for the retard operation mode, the hold mode, and the advance operation mode).

Also, when the VCT phase becomes unstably controlled to the target phase during the VCT phase control, it is assumed that the VCT-phase-control abnormality occurs, and thereby the variable range of the control duty of the hydraulic control valve 25 is set within a control range of the VCT phase control in order to execute the foreign object release control.

Furthermore, when the foreign object release control is executed, the control duty is changed between multiple values based on a predetermined pattern, and an initial value of the control duty of the hydraulic control valve 25 is also changed in accordance with the control mode during the start of the foreign object release control. For example, the above multiple values for the control duty includes at least three values in the present embodiment. Typically, the three values include an upper limit value and a lower limit value of the variable range of the control duty of the hydraulic control valve 25, and another value for the control duty (for example, a value for the hold duty).

Due to the above, in the execution of the foreign object release control, for example, it is possible to effectively avoid a situation, where the lock pin is strongly pressed against the wall of the lock hole, and thereby the lock pin is hard to be disengaged from the lock hole in the situation.

Specifically, when the VCT phase has not been stabilized at the intermediate lock position even after a predetermined period has elapsed since the control is switched from the VCT phase control to the lock pin projection control, it is assumed that the lock abnormality occurs. Thus, the variable range of the control duty of the hydraulic control valve 25 is set to cover the control range for the VCT phase control and the lock mode. Simultaneously, the initial value of the control duty of the hydraulic control valve 25 during the start of the foreign object release control is set at the limit value of the control range of the VCT phase control (for example, D100 in FIG. 5) to execute the foreign object release control. In the above, "D100" indicates a control duty of 100%.

Also, when the VCT phase has not been stabilized at the intermediate lock position even after a predetermined period has elapsed since the control is switched from the VCT phase control to the lock pin projection control, it is assumed that the lock abnormality occurs. Thus, when the operational state during the foreign object release control changes to a state that is different from (or that does not satisfy) the lock request condition, the execution of the foreign object release control is prohibited, and the control is changed to the VCT phase control.

Also, when the lock pin 58 has not been successfully retracted even after the predetermined period has elapsed since the control is switched from the lock pin projection control to the lock pin retraction control for retracting the lock pin 58, it is assumed that the lock-release abnormality occurs. Thus, the variable range of the control duty of the hydraulic control valve 25 is set to cover the control ranges of both of the lock mode and the control range of the VCT phase control. Also, the initial value of the control duty of the hydraulic control valve 25 during the start of the foreign object release control is set at a control duty (for example, hold duty Dh) other than the both limit values of the variable range of the control duty. Then, the foreign object release control is executed.

Also, when the lock pin 58 has not been successfully retracted even after the predetermined period has elapsed since the control is switched from the lock pin projection control to the lock pin retraction control, it is assumed that the lock-release abnormality occurs. Thus, the foreign object release control is executed as above. Subsequently, during the period for executing the foreign object release control, when the operational state changes to a state that is different from a lock-release-request condition, or when the VCT phase is displaced from the intermediate lock position, the execution of the foreign object release control is prohibited.

Also, when the VCT phase becomes incapable of following the target phase during the VCT phase control (or when the difference between the VCT phase and the target phase has remained equal to or greater than a predetermined value for a predetermined period during the VCT phase control), it is assumed that the VCT-phase-control abnormality occur. Thus, the variable range of the control duty of the hydraulic control valve 25 is set within the control range of the VCT phase control, and also the initial value of the control duty of the hydraulic control valve 25 during the start of the foreign object release control is set at a value, at which the VCT phase is displaceable toward the target phase at the highest speed (for example, Dt or D100 in FIG. 5). Then, the foreign object release control is executed.

Also, while the foreign object release control is executed, the control duty is periodically changed between two or more values. Also, simultaneously to the above, a pulse duration, during which the control duty is set at a certain value such that the VCT phase is shifted in a wanted direction determined based on the operational state, is made longer than a pulse duration, during which the control duty is set at a value other than the certain value. Alternatively, a pulse duration, during which the control duty is set at a certain value such that the VCT phase is shifted in a direction for preventing the operational state from deteriorating, is made longer than the pulse duration, during which the control duty is set at a value other than the certain value.

The above foreign object release control of the present embodiment is executed by the engine control circuit 21 in accordance with each routine shown in FIGS. 6 to 10. A procedure for each routine in FIGS. 6 to 10 will be described below. Each routine functions as foreign object release control means.

[Abnormal Mode Determination]

Figure 6:
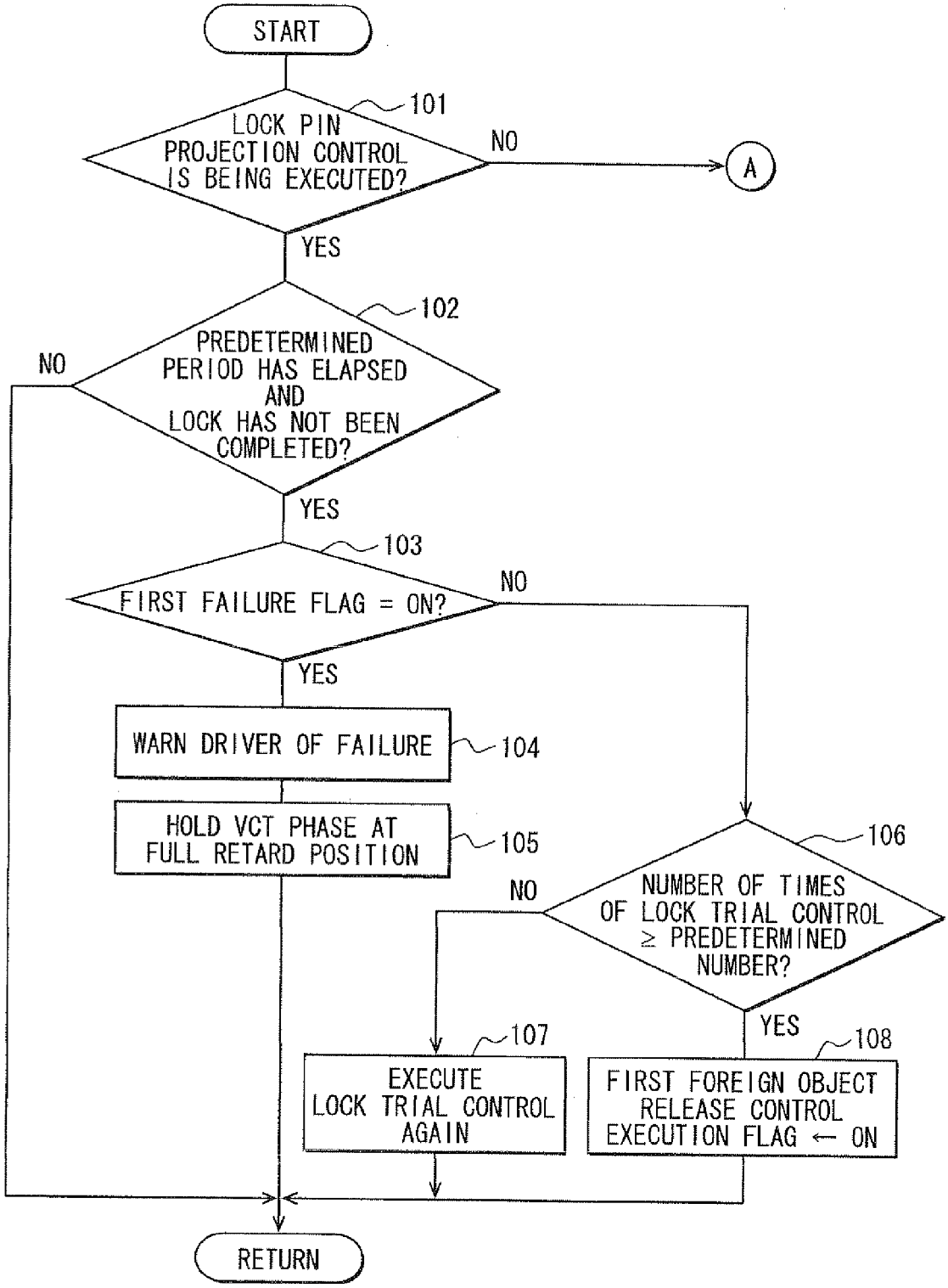
FIG. 6 is a flow chart for explaining a procedure of an abnormal mode determination routine.
Figure 7:
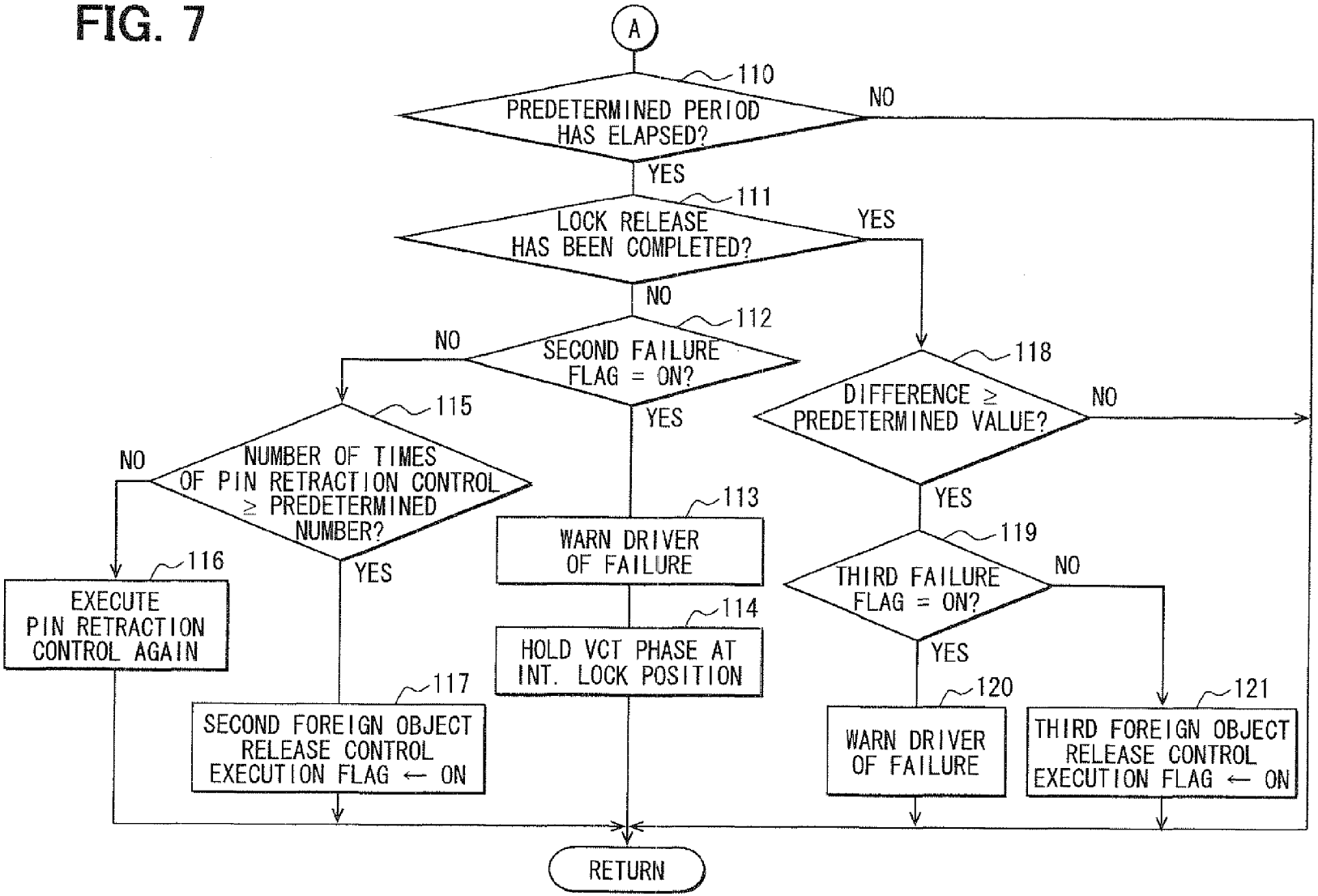
FIG. 7 is a flow chart for explaining a procedure of the abnormal mode determination routine continued from the procedure of FIG. 6.

The abnormal mode determination routine in FIG. 6 and FIG. 7 is repeatedly executed at predetermined intervals during the engine operation. When the present routine is started, firstly, at step 101, it is determined whether the lock pin projection control is being executed. When the lock pin projection control is being executed, control proceeds to step 102, where it is determined whether the following two conditions are simultaneously satisfied: (a) a predetermined period has elapsed since the start of the lock pin projection control; and (b) the lock has not been completed. When it is determined that the two conditions are not simultaneously satisfied, corresponding to "No" at step 102, the present routine is ended without executing the subsequent process.

When it is determined "Yes" at step 102 (in other words, the predetermined period has elapsed since the start of the lock pin projection control, and the lock has been completed), control proceeds to step 103, where it is determined whether a first failure flag is "ON". The first failure flag is turned "ON" when it is determined that "lock" failure occurs in a routine of the countermeasure process in the "lock" abnormality state shown in FIG. 8.

When it is determined at step 103 that the first failure flag=ON ("lock" failure), control proceeds to step 104, where a driver is given the warning of the failure through a lit or flashed warning lamp 70 (serving as warning means), through a warning displayed in a display portion at an instrument panel of the driver seat, or through a generated warning noise. Subsequently, control proceeds to step 105, where the target phase is set at the full retard position, which is a safer phase, such that the VCT phase is held at the full retard position.

In contrast, when it is determined at step 103 that the first failure flag=OFF (not "lock" failure), control proceeds to step 106, where it is determined whether a number of times of executing the lock trial control becomes equal to or greater than a predetermined number of times. When the number of times of executing the lock trial control has not reached the predetermined number of times, control proceeds to step 107, where the lock trial control is executed again. In the lock trial control, the VCT phase is shifted in a direction to pass the intermediate lock position by a predetermined amount to a position on the other side of the intermediate lock position. Then, the lock pin projection control is executed while the VCT phase is shifted in the opposite direction toward the intermediate lock position such that the lock pin 58 is engaged with or fitted into the lock hole 59.

Figure 8:
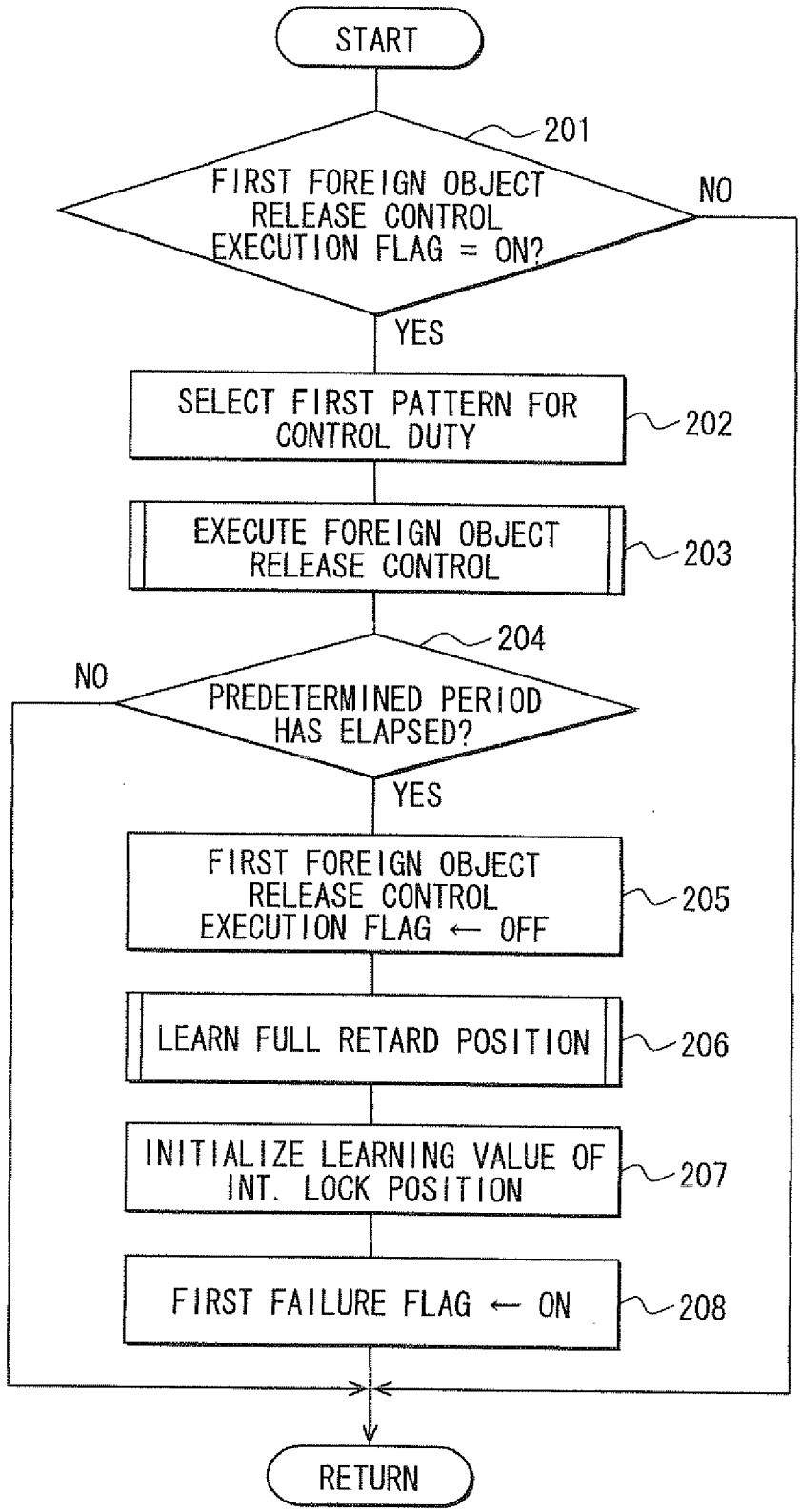
FIG. 8 is a flow chart for explaining a routine of a countermeasure process in a "lock" abnormality state.

When it is determined at step 106 that the number of times of executing the lock trial control becomes equal to or greater than the predetermined number of times, it is estimated that the "lock" abnormality occurs. Thus, control proceeds to step 108, where a first foreign object release control execution flag is turned "ON", and a routine of the countermeasure process in the "lock" abnormality state shown in FIG. 8 is executed.

Also, when it is determined at step 101 that the lock pin projection control is not being executed, control proceeds to step 110 in FIG. 7, where it is determined whether a predetermined period has elapsed since the start of the lock release control. When the predetermined period has not elapsed since the start of the lock release control, the present routine is ended without executing the subsequent process.

When it is determined at step 110 that the predetermined period has elapsed since the start of the lock release control, control proceeds to step 111, where it is determined whether the lock release has been completed. When it is determined that the lock release has not been completed, corresponding to "No" at step 111, control proceeds to step 112, where it is determined whether a second failure flag is "ON". The second failure flag is turned "ON" when it is determined that the "lock-release" failure occurs in the routine of the countermeasure process in the "lock-release" abnormality state shown in FIG. 9.

When it is determined at step 112 that the second failure flag=ON ("lock-release" failure), control proceeds to step 113, where the driver is given the warning of the failure through the lit or flashed warning lamp 70, through the warning displayed in the display portion at the instrument panel of the driver seat, or through the generated warning noise. Subsequently, control proceeds to step 114, where the target phase is set at the intermediate lock position such that the VCT phase is held at the intermediate lock position.

In contrast, when it is determined at step 112 that the second failure flag=OFF (not "lock-release" failure), control proceeds to step 115, where it is determined whether the number of times of executing the pin retraction control in the lock release control becomes equal to or greater than a predetermined number of times. When the number of times of executing the pin retraction control does not reach the predetermined number of times, control proceeds to step 116, where the pin retraction control is executed again. In the pin retraction control, the control duty (control amount) of the hydraulic control valve 25 is regulated in a limited range, in which the driving force for shifting the VCT phase in the advance direction or in the retard direction is equal to or less than a predetermined value. Thus, while the control duty is regulated in the limited range as above, the lock pin 58 is actuated in the lock release direction to be retracted such that the lock pin 58 is pulled out of the lock hole 59 in the pin retraction control.

Figure 9:
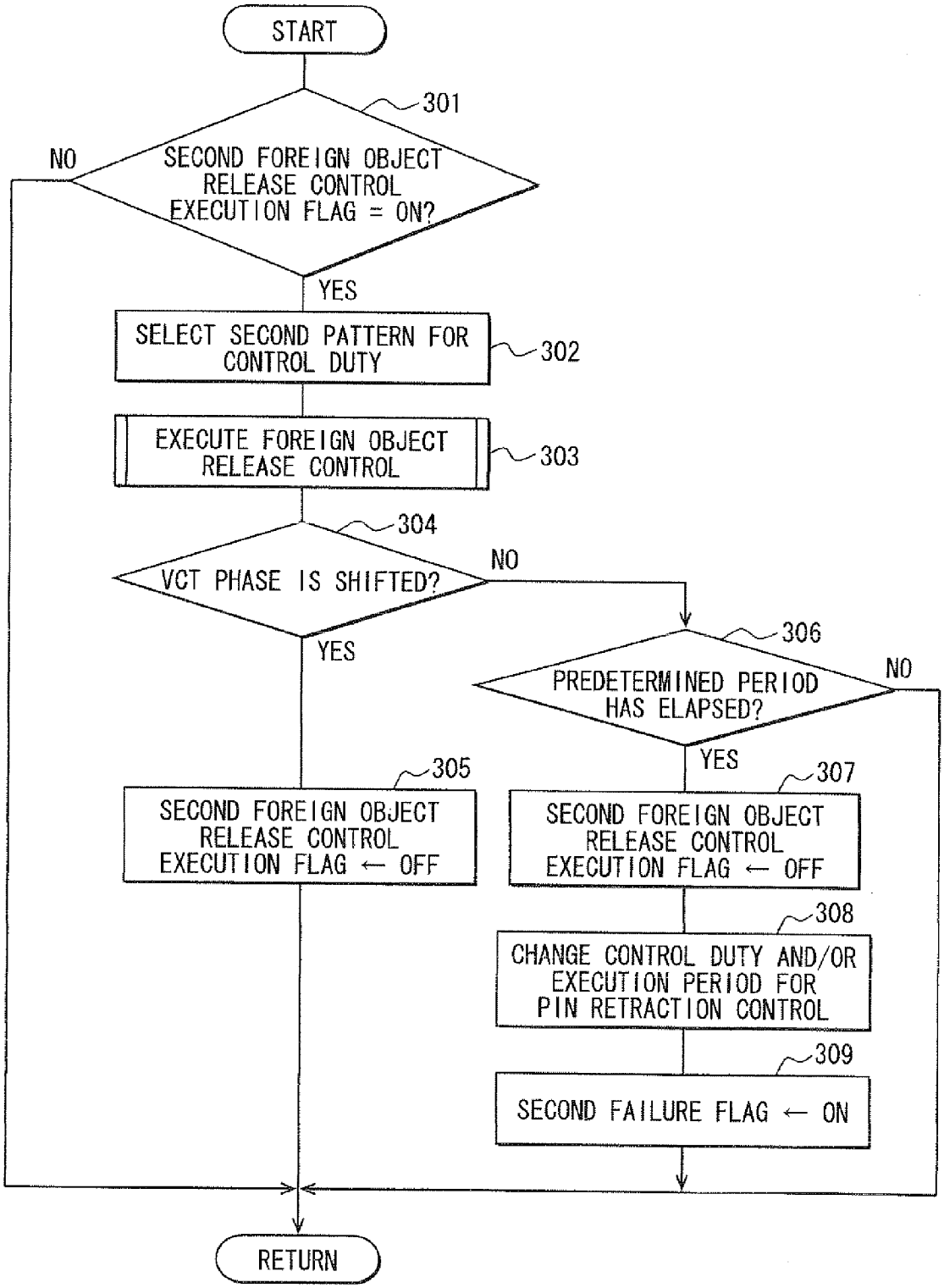
FIG. 9 is a flow chart for explaining a routine of a countermeasure process in a "lock-release" abnormality state.

When it is determined at step 115 that the number of times of executing the pin retraction control becomes equal to or greater than the predetermined number of times, it is estimated that the "lock-release" abnormality occurs. Thus, control proceeds to step 117, where a second foreign object release control execution flag is turned "ON", and the routine of the countermeasure process in the "lock-release" abnormality state shown in FIG. 9 is executed.

In contrast, when it is determined at step 111 that the lock release has been completed, corresponding to "Yes" at step 111, control proceeds to step 118, where it is determined whether the difference (absolute value) between the VCT phase and the target phase has remained equal to or greater than a predetermined value. When it is determined that the difference (absolute value) between the VCT phase and the target phase is less than the predetermined value, it is assumed that the VCT phase control normally controls the VCT phase toward the target phase, and thereby the present routine is ended.

When it is determined at step 118 that the difference (absolute value) between the VCT phase and the target phase has remained equal to or greater than the predetermined value, it is assumed that the "VCT-phase-control" abnormality occurs, and thereby control proceeds to step 119, where it is determined whether a third failure flag is "ON". The third failure flag is turned "ON" when it is determined that the "VCT phase control" failure occurs in a routine of the countermeasure process in the "VCT-phase-control" abnormality state shown in FIG. 10.

When it is determined at step 119 that the third failure flag=ON ("VCT phase control" failure), control proceeds to step 120, where the driver is given the warning of the failure by lighting and flashing of the warning lamp 70, by displaying the warning in the display portion of the instrument panel at the driver seat, and by generating the warning noise.

Figure 10:
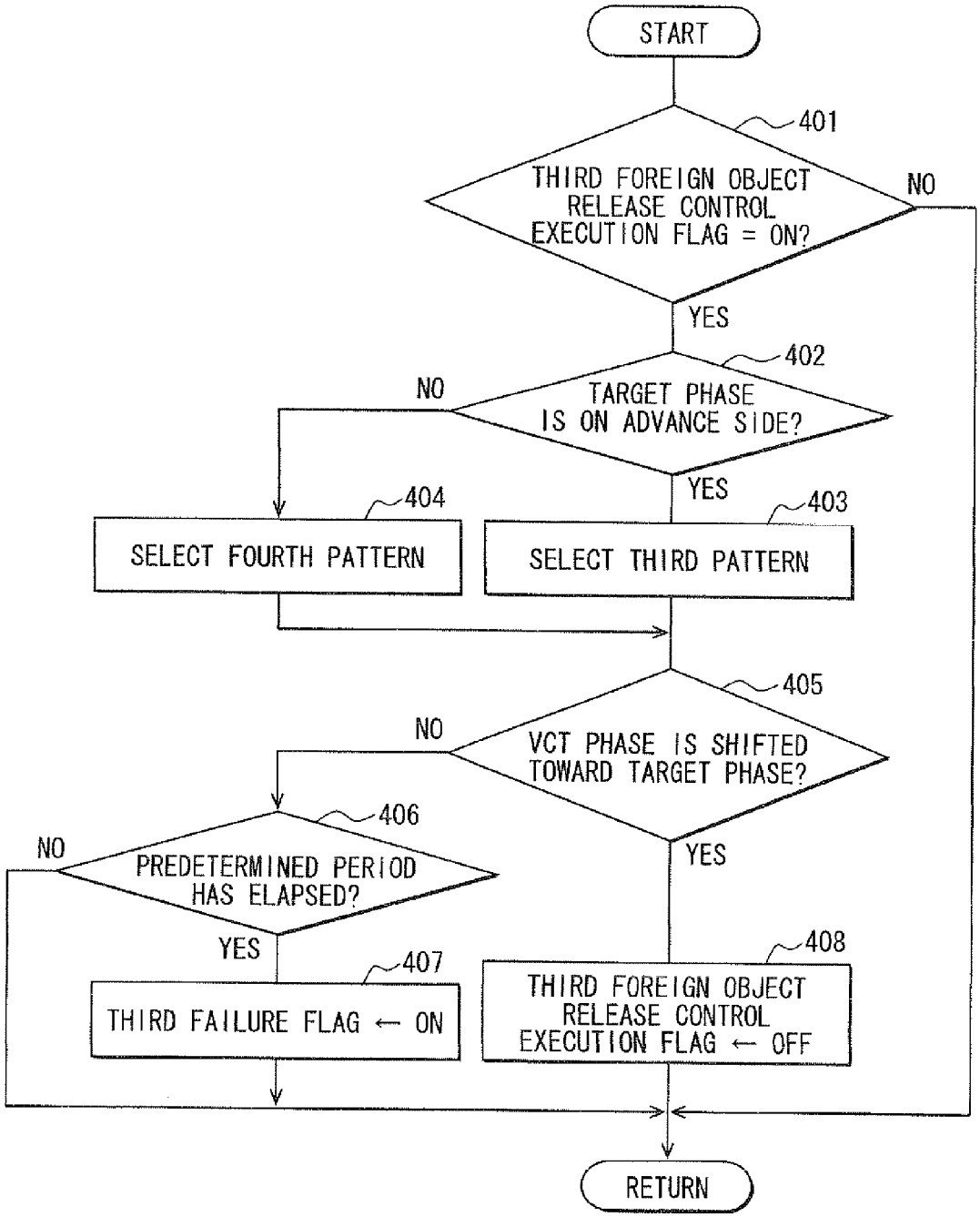
FIG. 10 is a flow chart for explaining routine of a countermeasure process in a "VCT-phase-control" abnormality state.

In contrast, when it is determined at step 119, the third failure flag=OFF (not "VCT phase control" failure), control proceeds to step 121, where a third foreign object release control execution flag is turned "ON", and the routine of the countermeasure process in the "VCT-phase-control" abnormality state shown in FIG. 10 is executed.

[Process in "Lock" Abnormality State]

A process routine of "lock" abnormality shown in FIG. 8 is repeatedly executed at predetermined intervals during the engine operation. When the present routine is started, firstly at step 201, it is determined whether the first foreign object release control execution flag is ON. When it is determined that the first foreign object release control execution flag is OFF, the present routine is ended without executing the subsequent process.

Figure 11:
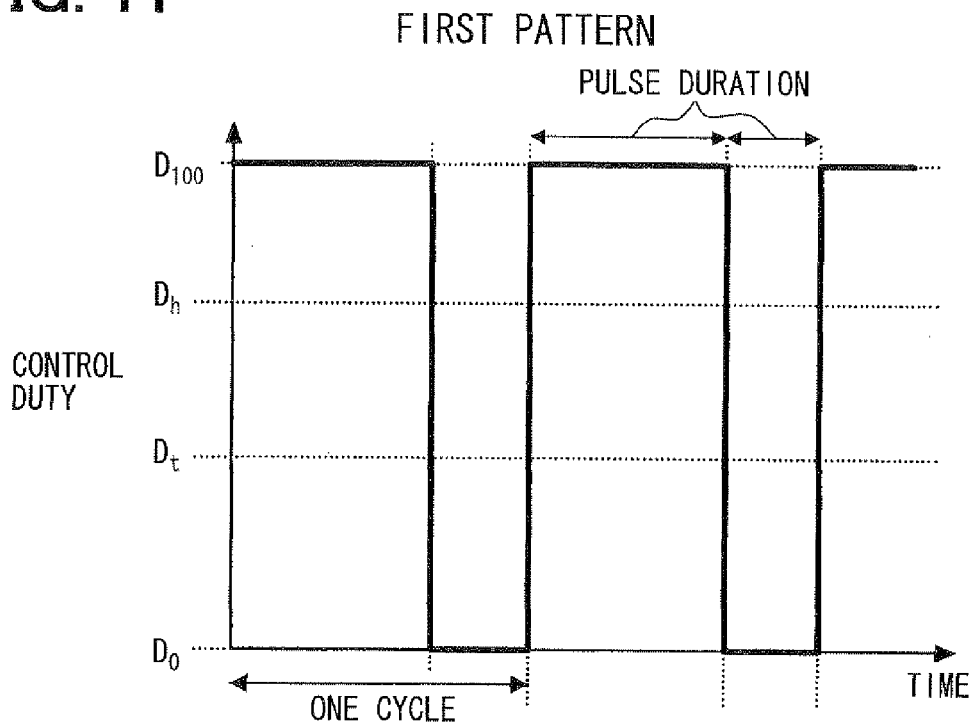
FIG. 11 is a timing chart for explaining a first pattern of the control duty of the hydraulic control valve in an execution of the foreign object release control in the "lock" abnormality state.

When it is determined at step 201 that the first foreign object release control execution flag is ON, control proceeds to step 202, where a first pattern shown in FIG. 11 is selected as a pattern for controlling the control duty in the foreign object release control. In other words, the first pattern of the control duty is selected for the foreign object release control in the "lock" abnormality state, and the variable range of the control duty in the first pattern covers the control range of the lock mode and the control range of the VCT phase control. Also, in the first pattern of the control duty, the control duty is periodically switched between the upper limit value D100 (control duty 100%) and the lower limit value D0 (control duty 0%) of the variable range of the control duty as shown in FIG. 11. Also, the initial value of the control duty at the start of the foreign object release control is set at the limit value (upper limit value D100) of the control range of the VCT phase control.

In the "lock" abnormality state, the lock of the VCT phase needs to be achieved. However, the VCT phase is likely to become unstable if the control duty is kept at the control duty D0, which is the limit value of the control range of the lock mode, for a relatively long time in a state, where the lock pin 58 is incapable of projecting. In other words, the VCT phase is likely to become unstable if the pulse duration, in which the control duty D0 is outputted, is relatively long in the above abnormality state. Thus, the pulse duration, in which the control duty D0 is outputted, is made shorter than the pulse duration, in which the control duty is at the control duty D100, which is the limit value of the control range of the VCT phase control, and at which the retard speed is maximum.

Subsequently, control proceeds to step 203, where the foreign object release control is executed by changing the control duty of the hydraulic control valve 25 based on the first pattern shown in FIG. 11. Then, at step 204, it is determined whether a predetermined period has elapsed since the start of the foreign object release control. When the predetermined period has not elapsed, the present routine is ended without executing the subsequent process.

In contrast, when it is determined at step 204 that the predetermined period has elapsed since the start of the foreign object release control, control proceeds to step 205, where the first foreign object release control execution flag is reset to be OFF, and control proceeds to step 206, where the VCT phase is retarded to the retard end, which corresponds to a wall defining the full retard position, in order to learn the full retard position.

Then, control proceeds to step 207, where a learning value of the intermediate lock position is initialized, and then control proceeds to step 208, where the first failure flag is turned ON, and the present routine is ended. Steps 206 and 207 correspond to reference phase learning means.

[Process in "Lock-Release" Abnormality State]

The routine of the countermeasure process in the "lock-release" abnormality state shown in FIG. 9 is repeatedly executed at predetermined intervals during the engine operation. When the present routine is started, firstly, it is determined at step 301 whether the second foreign object release control execution flag is ON. When it is determined that the second foreign object release control execution flag is OFF, the present routine is ended without executing the subsequent process.

Figure 12:
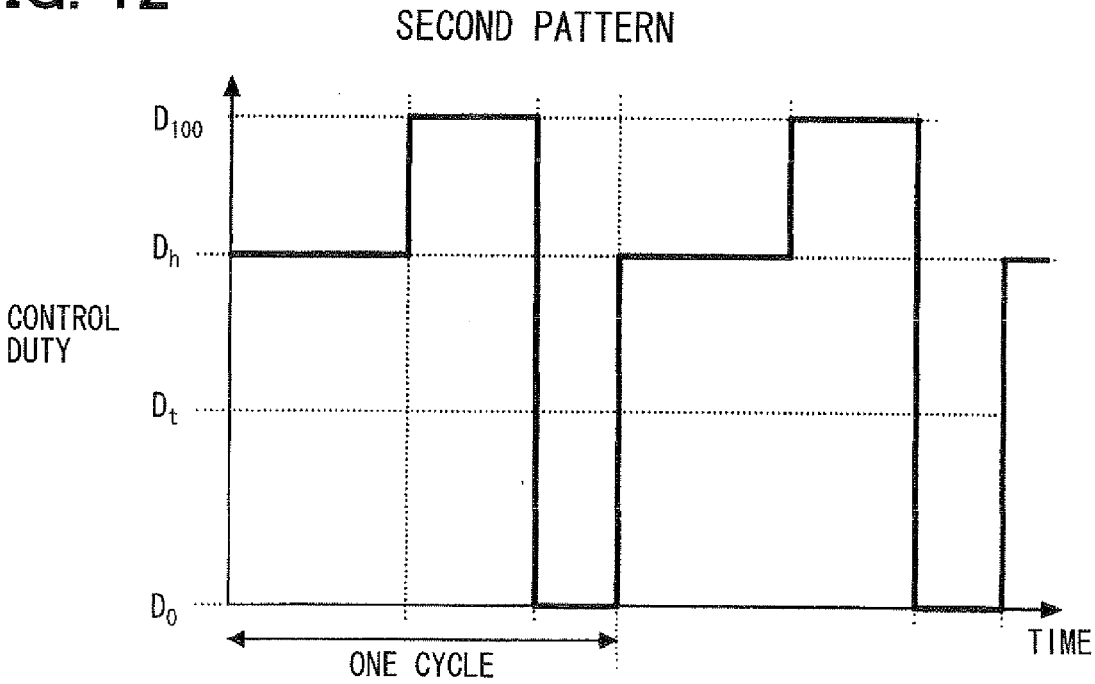
FIG. 12 is a timing chart for explaining a second pattern of the control duty of the hydraulic control valve in the execution of the foreign object release control in the "lock-release" abnormality state.

When it is determined at step 301 that the second foreign object release control execution flag is ON, control proceeds to step 302, where a second pattern shown in FIG. 12 is selected as the pattern of controlling the control duty in the foreign object release control. In other words, the second pattern of the control duty is selected for the foreign object release control in the "lock-release" abnormality state. The variable range of the control range of the second pattern covers the control range of the lock mode and the control range of the VCT phase control, and the control duty is switched between at least three values at predetermined intervals based on a predetermined pattern. For example, the three values include the upper limit value D100 and the lower limit value D0 of the variable range of the control duty, and a value (for example, the hold duty Dh) other than the above limit values. Then, the initial value of the control duty at the start of the foreign object release control is set at the control duty (for example, hold duty Dh) other than the both limit values of the variable range of the control duty.

Due to the above, when the abnormality of the lock-release abnormality occurs, the initial value of the control duty of the hydraulic control valve is set within the control range of the hold mode, for example, at the start of the foreign object release control. As a result, it is possible to effectively avoid the situation, where the lock pin is strongly pressed against the wall of the lock hole at the start of the foreign object release control. Therefore, it is possible to facilitate the disengagement of the lock pin from the lock hole.

In the "lock-release" abnormality state, because the lock of the VCT phase needs to be released, the pulse duration, during which the control duty is at the hold duty Dh, is set relatively longer such that the driving force for shifting the VCT phase in the advance direction or in the retard direction is regulate to be equal to or less than the predetermined value. In the above state, it is possible to secure substantial time period, in which the lock pin 58 is pulled out of the lock hole 59. Also, the pulse duration, during which the control duty is at the upper limit value D100 (at which the retard speed is maximum) of the variable range of the control duty, is made longer than the pulse duration, during which the control duty is at the lower limit value D0, in order to shift the VCT phase from the intermediate lock position in the retard direction (safer direction).

Subsequently, control proceeds to step 303, where the foreign object release control is executed by changing the control duty of the hydraulic control valve 25 based on the second pattern of FIG. 12. Then, at subsequent step 304, it is determined whether the VCT phase is shifted. When it is determined that the VCT phase is shifted, it is assumed that the lock release has been completed, and thereby control proceeds to step 305, where the second foreign object release control execution flag is reset to be OFF, and the present routine is ended.

In contrast, when it is determined at step 304 that the VCT phase is not shifted, it is assumed that the lock release has not been completed, and thereby control proceeds to step 306, where it is determined whether a predetermined period has elapsed since the start of the foreign object release control. When the predetermined period has not elapsed, the present routine is ended without executing the subsequent process.

In contrast, when it is determined at step 306 that the predetermined period has elapsed since the start of the foreign object release control, control proceeds to step 307, where the second foreign object release control execution flag is reset to be OFF. Then, control proceeds to step 308, where a control amount and/or an execution period of the pin retraction control is changed. Subsequently, control proceeds to step 309, where the second failure flag is turned ON, and the present routine is ended.

[Process in "VCT-Phase-Control" Abnormality State]

The routine of the countermeasure process in the "VCT-phase-control" abnormality state shown in FIG. 10 is repeatedly executed at predetermined intervals during the engine operation. When the present routine is started, firstly, it is determined at step 401 whether the third foreign object release control execution flag is ON. When it is determined that the third foreign object release control execution flag is OFF, the present routine is ended without executing the subsequent process.

Figure 13A:
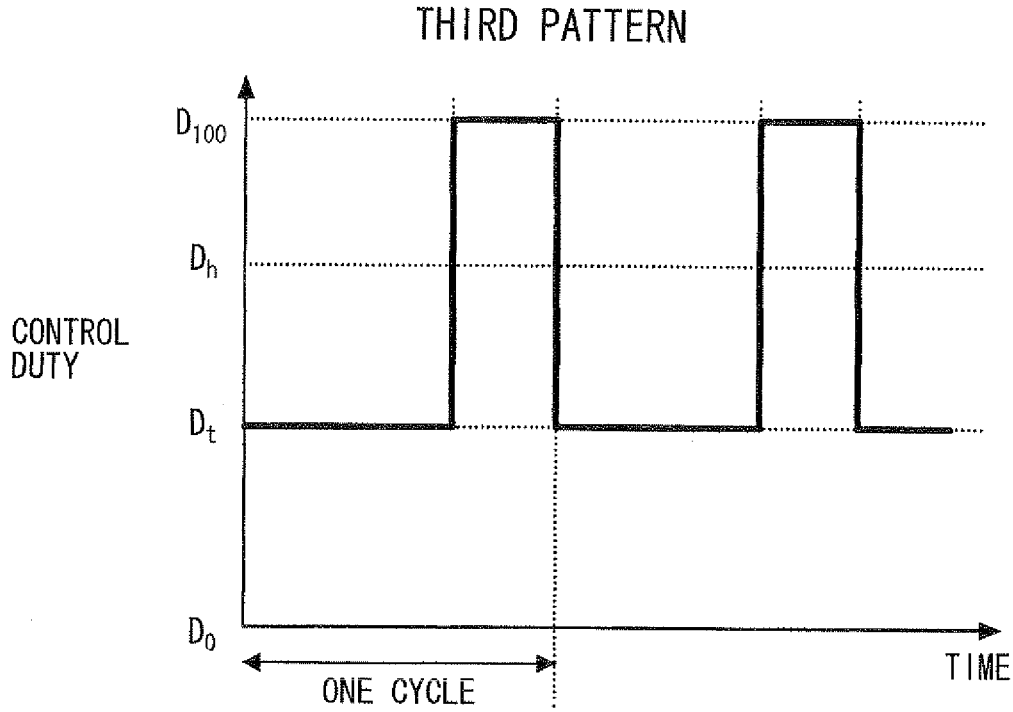
FIG. 13A is a timing chart for explaining a third pattern of the control duty of the hydraulic control valve in the execution of the foreign object release control in the "VCT-phase-control" abnormality state.

When it is determined at step 401 that the third foreign object release control execution flag is ON, control proceeds to step 402, where it is determined whether the target phase is located on an advance side of the present VCT phase. When it is determined that the target phase is located on the advance side of the present VCT phase, control proceeds to step 403, where a third pattern shown in FIG. 13A is selected as the pattern of the control duty for the foreign object release control in the "VCT-phase-control" abnormality state.

As above, the third pattern of the control duty is selected in the foreign object release control in the "VCT-phase-control" abnormality state. The control duty of the third pattern is periodically switched between the lower limit value Dt and the upper limit value D100 of the control range of the VCT phase control. The initial value of the control duty at the start of the foreign object release control is set at the lower limit value Dt of the control range of the VCT phase control. In other words, the initial value of the control duty at the start of the foreign object release control is set at a control duty, at which the VCT phase is shifted in the advance direction toward the target phase at a maximum speed (or at which driving force in the advance direction is maximum). Also, a pulse duration, during which the control duty is at the lower limit value Dt of the control range of the VCT phase control, is made longer than a pulse duration, during which the control duty is at the upper limit value D100.

Figure 13B:
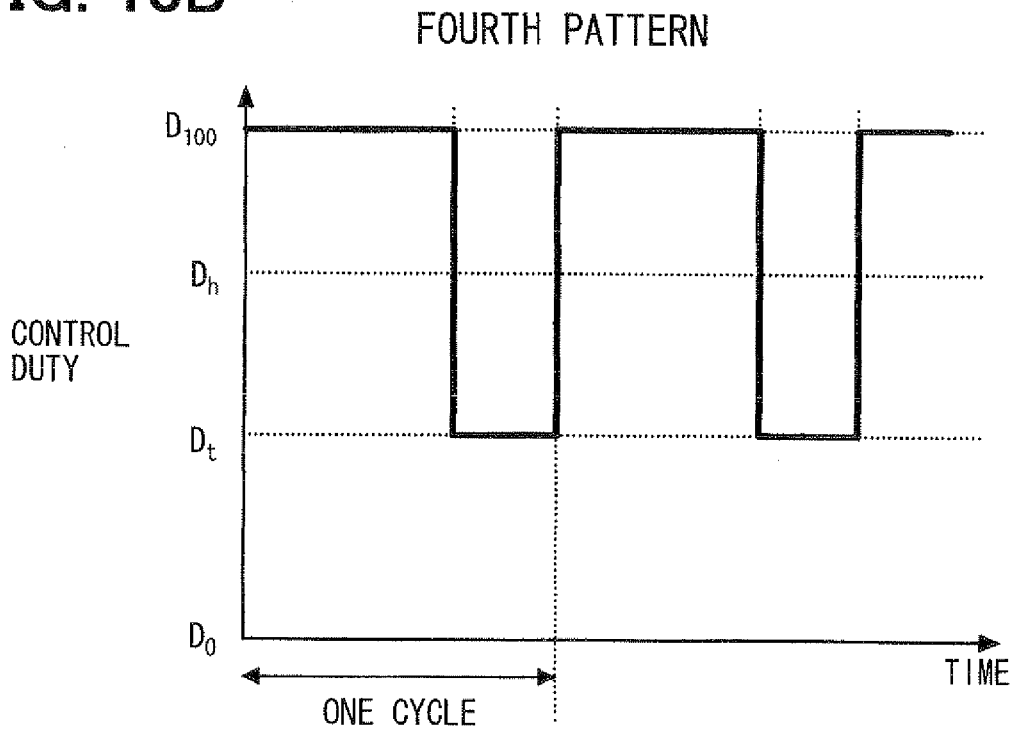
FIG. 13B is a timing chart for explaining a fourth pattern of the control duty of the hydraulic control valve in the execution of the foreign object release control in the "VCT-phase-control" abnormality state.

In contrast, when it is determined at step 402 that the target phase is on a retard side of the present VCT phase, control proceeds to step 404, where a fourth pattern shown in FIG. 13B is selected as the pattern of the control duty for the foreign object release control in the "VCT-phase-control" abnormality state.

As above, the fourth pattern of the control duty is selected for the foreign object release control in the "VCT-phase-control" abnormality state. In the fourth pattern, the control duty is periodically switched between the upper limit value D100 and the lower limit value Dt of the control range of the VCT phase control. Also, the initial value of the control duty at the start of the foreign object release control is set at the upper limit value D100 of the control range of the VCT phase control. In other words, the initial value of the control duty is set at a control duty, at which the VCT phase is shifted in the retard direction toward the target phase at the maximum speed (or at which the driving force in the retard direction is maximum). Simultaneously, a pulse duration, during which the control duty is at the upper limit value D100 (at which the retard speed is maximum) of the control range of the VCT phase control, is made longer than a pulse duration, during which the control duty is at the lower limit value Dt (at which the advance speed is maximum).

As above, after selecting the pattern of the control duty, control proceeds to step 405, where it is determined whether the VCT phase is shifted in the direction toward the target phase. When it is determined that the VCT phase is shifted in the direction toward the target phase, control proceeds to step 408, where the third foreign object release control execution flag is reset to be OFF, and the present routine is ended.

In contrast, when it is determined at step 405 that the VCT phase is not shifted in the direction toward the target phase, control proceeds to step 406, where it is determined whether a predetermined period has elapsed since the start of the foreign object release control. When the predetermined period has not elapsed, the present routine is ended without executing the subsequent process.

In contrast, when it is determined at step 406 that the predetermined period has elapsed since the start of the foreign object release control, it is estimated that the "VCT phase control" failure occurs, and thereby control proceeds to step 407, where the third failure flag is turned ON. Then, control proceeds to step 408, where the third foreign object release control execution flag is reset to be OFF, and the present routine is ended.

Examples of processes executed by each routine shown in FIGS. 6 to 10 during the abnormal state will be described with reference to FIGS. 14 to 16.

Figure 14:
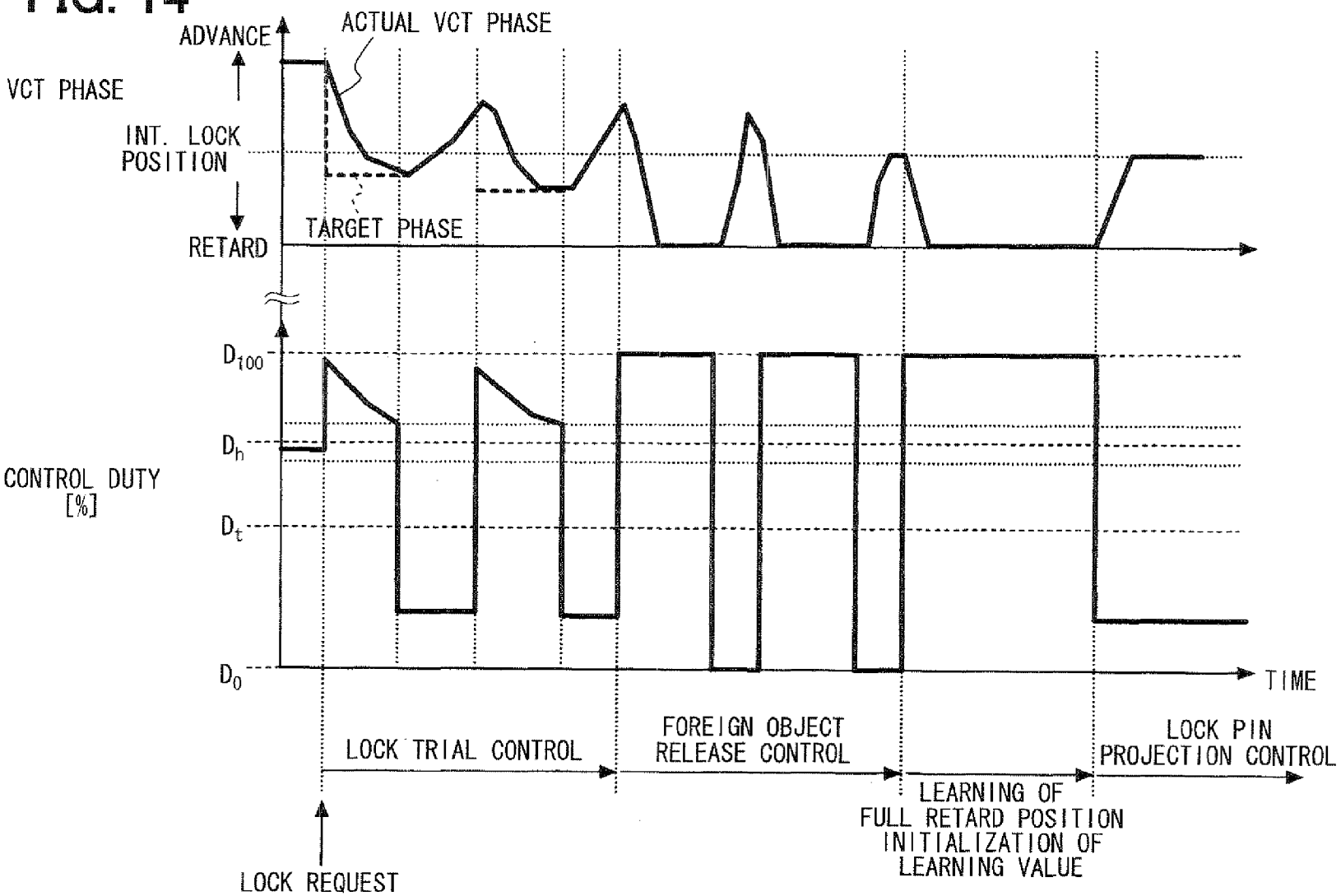
FIG. 14 is a timing chart for explaining one example of a process in the "lock" abnormality state.

FIG. 14 is a timing chart illustrating one example of the process in the "lock" abnormality state.

In the example of FIG. 14, the VCT phase is controlled by the VCT phase control based on the target phase that is on the advance side of the intermediate lock position. Upon the generation of the lock request during the VCT phase control as above, the lock trial control is executed, in which firstly, the target phase is changed to a position that is on the retard side of the intermediate lock position displaced by a predetermined amount. In other words, the above target phase is away from the intermediate lock position by the predetermined amount in the retard direction. Then, according to the above target phase, the VCT phase is shifted to pass the intermediate lock position to reach the position on the retard side of the intermediate lock position, which is away from the lock position by the predetermined amount. Then, the control duty of the hydraulic control valve 25 is set within the control range of the lock mode in order to execute the lock pin projection control while the VCT phase is moved toward the intermediate lock position such that the lock pin 58 locks the VCT phase. When the lock has not become completed (when the lock pin 58 does not lock the VCT phase) even after the lock pin projection control in the lock trial control has been executed for a predetermined period, the amount, by which the VCT phase is shifted to pass the intermediate lock position, is increased, and then the lock trial control is executed again. The above process is repeated the lock is completed.

When the lock has not been completed even after the number of times of executing the lock trial control reaches the predetermined number of times, it is assumed at the time that the "lock" abnormality occurs, and thereby the foreign object release control is started. In the foreign object release control in the "lock" abnormality state, the control duty of the hydraulic control valve 25 is periodically switched between (a) the upper limit value D100 of the control range of the VCT phase control and (b) the control duty D0 that is the limit value of the control range of the lock mode. In the above, the initial value of the control duty at the start of the foreign object release control is set at the upper limit value D100 of the control range of the VCT phase control. For example, when the control duty is at the upper limit value D100, the VCT phase is shifted in the retard direction toward the target phase at the maximum speed or the driving force in the retard direction is maximum. Also, the pulse duration, during which the control duty is at the upper limit value D100 of the control range of the VCT phase control, is made longer than pulse duration, during which the control duty is at the control duty D0 that is the limit value of the control range of the lock mode.

After the foreign object release control has been executed for the predetermined period, the control duty of the hydraulic control valve 25 is set at the control duty D100 that is the limit value of the control range of the VCT phase control in order to learn the full retard position by shifting the VCT phase to the full retard position (reference phase). Also, the learning value of the intermediate lock position is initialized. Subsequently, the control duty of the hydraulic control valve 25 is again set within the control range of the lock mode, and the lock pin projection control (lock trial control) is executed to try to lock the lock pin 58.

When the lock has not been completed even after the lock pin projection control (lock trial control) has been executed once or more times, it is assumed that that "lock" failure occurs. Thus, in the above case, in order to provide the warning of the failure to the driver, the warning lamp 70 is lit or flashed, the warning is displayed in the display portion of the instrument panel for the driver seat, or the warning noise is generated. Subsequently, upon the generation of the lock request, the VCT phase control controls the VCT phase such that the VCT phase is held at any one of the intermediate lock position, the full retard position, and the full advance position.

Figure 15:
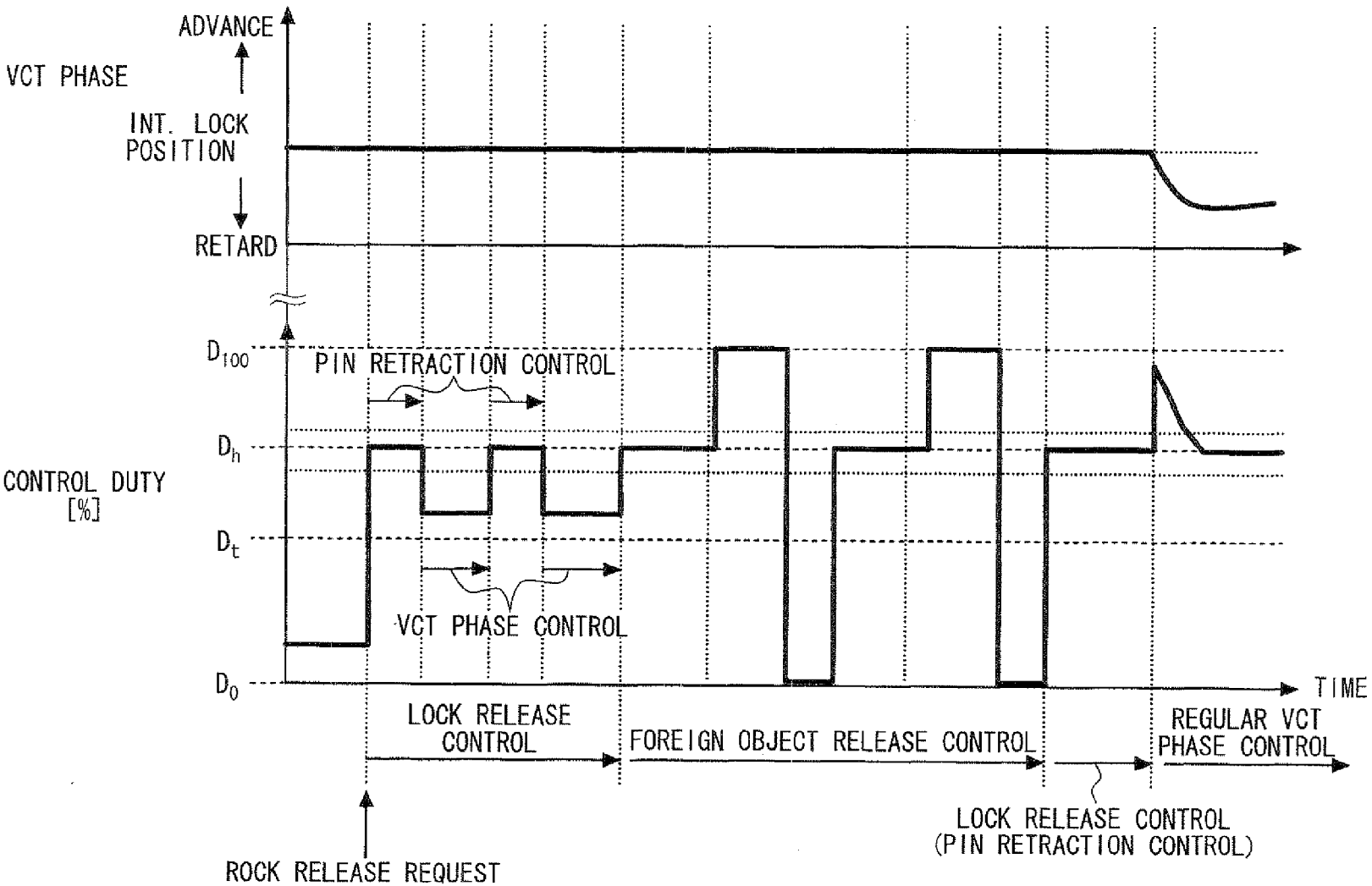
FIG. 15 is a timing chart for explaining one example of a process in the "lock-release" abnormality state.

FIG. 15 is a timing chart illustrating one example of the process in the "lock-release" abnormality state.

In the example of FIG. 15, the pin retraction control of the lock release control is started upon the generation of the lock release request while the VCT phase is locked at the intermediate lock position. In the pin retraction control, the control duty of the hydraulic control valve 25 is set at the hold duty Dh such that the VCT phase is held around the intermediate lock position with the driving force for shifting the VCT phase in the advance direction or in the retard direction limited to equal to or less than the predetermined value. Thus, the lock pin 58 is to be retracted in the lock release direction under the above operational condition in the pin retraction control.

After the pin retraction control has been executed for a predetermined period, the VCT phase control is started to shift the VCT phase toward the target phase. When the VCT phase is not shifted from the intermediate lock position even after the VCT phase control has been executed for the predetermined period, the lock release control (the pin retraction control and the VCT phase control) is again executed once or more times. When the VCT phase is still not shifted from the intermediate lock position even after the above repetition of the lock release control, it is assumed that the "lock-release" abnormality occurs, and thereby the foreign object release control is executed.

In the foreign object release control in the "lock-release" abnormality state, the control duty of the hydraulic control valve 25 is periodically switched between (a) the hold duty Dh for holding the VCT phase around the intermediate lock position, (b) the control duty D100 for causing the retard speed at maximum, and (c) the control duty D0 that is the limit value of the control range of the lock mode. In the above, the initial value of the control duty at the start of the foreign object release control is set at the hold duty Dh. Also, a pulse duration, during which the control duty is at the hold duty Dh, is made relatively longer such that a time period, in which the lock pin 58 is allowed to be retracted from the lock hole 59, is made substantially long. Also, a pulse duration, during which the control duty is at the control duty D100, is made longer than a pulse duration, during which the control duty is at the control duty D0, such that the VCT phase is shifted in the retard direction (safe direction) from the intermediate lock position.

After the foreign object release control has been executed for the predetermined period, the control duty of the hydraulic control valve 25 is again set at the hold duty Dh to execute the lock release control (pin retraction control). The example of FIG. 15 shows that the lock release control (pin retraction control) causes the VCT phase to be shifted from the intermediate lock position such that the lock release is completed (the lock pin 58 is successfully pulled out of the lock hole 59, for example), and thereby the regular VCT phase control is executed thereafter.

The pin retraction control of the lock release control after the end of the foreign object release control may be executed based on the control duty and the execution period similarly to those of the regular pin retraction control of the lock release control. Alternatively, the pin retraction control of the lock release control after the end of the foreign object release control may be executed based on the control duty or the execution period that are different from the regular pin retraction control of the lock release control.

Note that, when the VCT phase is still not shifted from the intermediate lock position even though the lock release control (pin retraction control) is executed once or more after the end of the foreign object release control, it is assumed that the "lock-release" failure occurs. Thus, in the above case, the driver is given the warning of the failure through the lit or flashed warning lamp 70, through the warning displayed in the display portion at the instrument panel of the driver seat, or through the generated warning noise. Subsequently, the control duty of the hydraulic control valve 25 is set within the control range of the lock mode under any operational conditions, and the lock pin 58 is actuated in the lock release direction to be pulled out of the lock hole 59.

Figure 16:
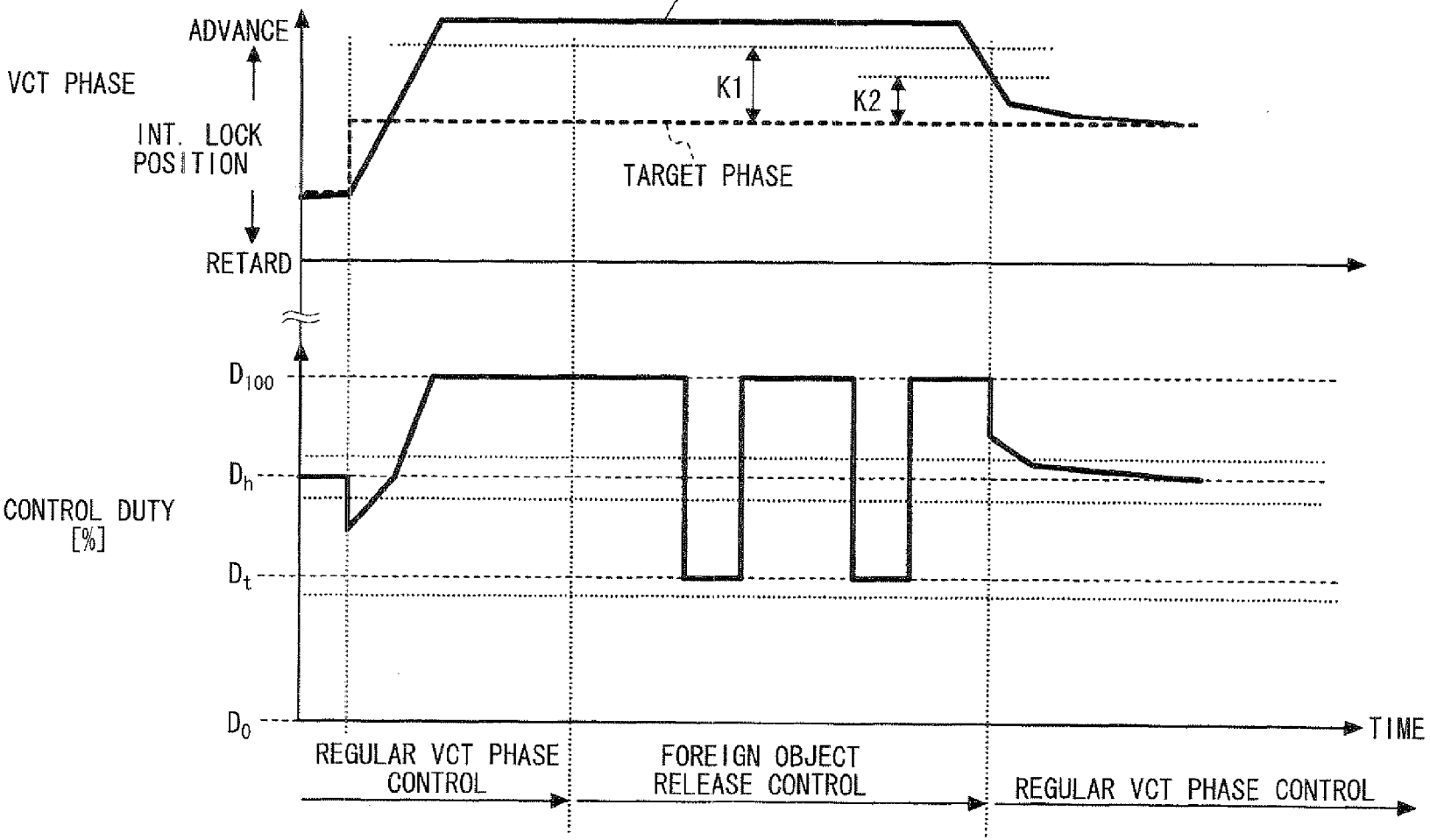
FIG. 16 is a timing chart for explaining one example of a process in the "VCT-phase-control" abnormality state.

FIG. 16 is a timing chart illustrating one example of the process in the "VCT-phase-control" abnormality state. In the example of FIG. 16, when it is determined that the difference (absolute value) between the VCT phase and the target phase has remained equal to or greater than a predetermined value K1 during the execution of the regular VCT phase control, it is assumed that the "VCT-phase-control" abnormality occurs, and thereby the foreign object release control is executed.

In the foreign object release control in the "VCT-phase-control" abnormality state, the control duty of the hydraulic control valve 25 is periodically switched between the upper limit value D100 and the lower limit value Dt of the control range of the VCT phase control. More specifically, the initial value of the control duty at the start of the foreign object release control is set at the upper limit value D100 of the control range of the VCT phase control. Also, the pulse duration, during which the control duty is at the upper limit value D100 of the control range of the VCT phase control (retard speed is maximum), is made longer than the pulse duration, during which the control duty is at the lower limit value Dt (advance speed is maximum) in the foreign object release control. For example, when the control duty is set at the upper limit value D100, the VCT phase is shifted in the direction (in the retard direction in the example of FIG. 16) toward the target phase at maximum speed. In other words, when the control duty is set at the upper limit value D100, the driving force in the retard direction is maximum.

When the difference (absolute value) between the VCT phase and the target phase becomes equal to or less than the predetermined value K2 due to the foreign object release control, it is assumed that the "VCT-phase-control" abnormality is overcome, and thereby the control is changed back to the regular VCT phase control. In the above, the predetermined value K2 is smaller than the predetermined value K1.

In the present embodiment, when the foreign object release control is execute upon the detection of the abnormality, the variable pattern (variable range) of the control duty of the hydraulic control valve 25 is selectively changed in accordance with the abnormality (abnormal mode). As a result, for example, when the foreign object release control is executed upon the generation of abnormality during a period, in which the lock pin 58 is prohibited from projecting, it is possible to limit the variable range of the control duty of the hydraulic control valve 25 within the control range other than the control range of the lock mode (or in other words, within the control range of the VCT phase control). As a result, it is possible to prevent the generation of the abnormal noise and the deterioration of the components otherwise caused by the repeated collision of the lock pin 58 with a wall surface that defines the lock hole 59 during the execution of the foreign object release control.

In a case, where the present invention is applied to a system, in which a variable valve timing unit is provided to each of multiple cylinder groups of an engine, when it is determined that the failure occurs to a certain one of the cylinder groups, the other one of the cylinder groups may be controlled similarly to the control of the certain one of the cylinder groups, which control is determined based on the failure of the certain one of the cylinder groups.

Note that, the present invention is embodied as the variable valve timing control apparatus of the intake valve in the present embodiment. However, the present invention may be alternatively applicable to a variable valve timing control apparatus of the exhaust valve. In the alternative case, where the present invention is applied to the variable valve timing control apparatus of the exhaust valve, a direction of controlling the VCT phase of the exhaust valve may be alternatively set opposite from the direction of controlling the VCT phase of the intake valve in the above embodiment. In other words, a directional relation between "timing advance" and "timing retard" in the above embodiment may be reversed in the alternative embodiment for the exhaust valve.

Also, the present invention may be applied to a configuration, in which the VCT phase-control hydraulic control valve for controlling the oil pressure that actuates the VCT phase is separated from the lock-control hydraulic control valve for controlling the oil pressure that actuates the lock pin 58.

In the above embodiment, when the abnormality occurs during a certain operation, the foreign object release control is executed by setting the variable range of the control duty of the hydraulic control valve 25 such that the variable range covers both of the control range of the lock mode and the control range of the VCT phase control or such that the variable range is limited to one of (a) the control range of the lock mode and (b) the control range of the VCT phase control. In the above, the certain operation corresponds to at least one of the followings: (1) the lock pin projection control; (2) the VCT phase control; (3) a transitional operation for switching the control from the lock pin projection control to the VCT phase control; and (4) a transitional operation for switching the control from the VCT phase control to the lock pin projection control.

As described in the above embodiments, the initial value of the control duty of the hydraulic control valve at the start of the foreign object release control is changeable in accordance with the control mode. In the above, for example, if the VCT phase control has been performed by the start of the foreign object release control, the initial value of the control duty of hydraulic control valve is set at a control value in order to avoid the sharp change of the VCT phase. Also, if the lock pin projection control has been performed by the start of the foreign object release control, the initial value of the control amount of hydraulic control valve is set at a control value in order to avoid the situation, where the lock pin is strongly pressed against the wall that defines the lock hole.

The present invention may be modified in a various manner provided that the modification does not deviate from the gist of the present invention. For example, a configuration of the variable valve timing unit 18 and a configuration of the hydraulic control valve 25 may be modified as required.

In the above embodiment, the term "pattern" of the control duty may indicate "control waveform" for controlling the duty cycle in terms of the amplitude and time interval (pulse duration).

Additional advantages and modifications will readily occur to those skilled in the art. The invention in its broader terms is therefore not limited to the specific details, representative apparatus, and illustrative examples shown and described.

What is claimed is:

1. A variable valve timing control apparatus for an internal combustion engine that has:

a crankshaft;

a camshaft;

a hydraulic variable valve timing unit configured to adjust valve timing by changing a variable cam timing (VCT) phase that is a rotational phase of the camshaft relative to the crankshaft;

a lock pin configured to lock the VCT phase at an intermediate lock position located within an adjustable range of the VCT phase; and a hydraulic control valve configured to control oil pressure that actuates the variable valve timing unit and the lock pin, the variable valve timing control apparatus comprising:

VCT control means for switching a control, based on an operational state, between (a) a VCT phase control for controlling the VCT phase to a target phase and (b) a lock pin projection control for allowing the lock pin to project; and foreign object release control means for executing, when an abnormality occurs, a foreign object release control for changing a control amount of the hydraulic control valve based on a predetermined pattern, wherein the foreign object release control means changes the predetermined pattern depending on the abnormality in the execution of the foreign object release control.

2. The variable valve timing control apparatus according to claim 1, wherein:

the hydraulic control valve integrally includes first means for controlling oil pressure that actuates the VCT phase and second means for controlling oil pressure that actuates the lock pin;

the hydraulic control valve is operated under the following control modes based on the control amount of the hydraulic control valve:

a retard operation mode, in which the hydraulic control valve causes the VCT phase to be shifted in a retard direction;

a hold mode, in which the hydraulic control valve causes the VCT phase to be held;

an advance operation mode, in which the hydraulic control valve causes the VCT phase to be shifted in an advance direction; and a lock mode, in which the hydraulic control valve allows the lock pin to project in a lock direction;

in the execution of the VCT phase control, the VCT control means controls the VCT phase to the target phase based on the control amount within a control range that includes a control range of the retard operation mode, a control range of the hold mode, and a control range of the advance operation mode; and in the execution of the lock pin projection control, the VCT control means allows the lock pin to project based on the control amount within a control range of the lock mode.

3. The variable valve timing control apparatus according to claim 2, wherein:

when the abnormality occurs during at least one of the following operations:

(1) the lock pin projection control;

(2) the VCT phase control;

(3) a transitional operation for switching the control from the lock pin projection control to the VCT phase control; and (4) a transitional operation for switching the control from the VCT phase control to the lock pin projection control, the foreign object release control means executes the foreign object release control by setting a variable range of the control amount of the hydraulic control valve such that the variable range covers both of the control range of the lock mode and the control range of the VCT phase control or such that the variable range is limited to one of the control range of the lock mode and the control range of the VCT phase control.

4. The variable valve timing control apparatus according to claim 2, wherein:

when the VCT phase has not been stabilized at the intermediate lock position even after a predetermined period has elapsed since the control is switched from the VCT phase control to the lock pin projection control, the foreign object release control means determines that the abnormality of a lock occurs, and the foreign object release control means executes the foreign object release control by setting a variable range of the control amount of the hydraulic control valve such that the variable range of the control amount covers the control range of the VCT phase control and the control range of the lock mode; and when the lock pin has not been retracted even after a predetermined period has elapsed since the control is switched from the lock pin projection control to a pin retraction control for retracting the lock pin, or when the VCT phase has not been stabilized at the target phase even after a predetermined period has elapsed since the control is switched from the lock pin projection control to the VCT phase control, the foreign object release control means determines that the abnormality of a lock release occurs, and the foreign object release control means executes the foreign object release control by setting the variable range of the control amount of the hydraulic control valve such that the variable range of the control amount covers the control range of the lock mode and the control range of the VCT phase control.

5. The variable valve timing control apparatus according to claim 2, wherein:

when the VCT phase becomes unstably controlled to the target phase during the VCT phase control, the foreign object release control means determines that the abnormality of the VCT phase control occurs and executes the foreign object release control by setting a variable range of the control amount of the hydraulic control valve within the control range of the VCT phase control.

6. The variable valve timing control apparatus according to claim 2, wherein:

when the foreign object release control means changes the control amount of the hydraulic control valve based on the predetermined pattern between at least three control values in the execution of the foreign object release control; and the at least three control values include:

(a) an upper limit value of a variable range of the control amount of the hydraulic control valve;

(b) a lower limit value of the variable range of the control amount of the hydraulic control valve; and (c) a control value other than the upper limit value and the lower limit value.

7. The variable valve timing control apparatus according to claim 2, wherein:

the foreign object release control means changes an initial value of the control amount of the hydraulic control valve during a start of the foreign object release control in accordance with the control mode of the hydraulic control valve.

8. The variable valve timing control apparatus according to claim 2, wherein:

when the VCT phase has not been stabilized at the intermediate lock position even after a predetermined period has elapsed since the control is switched from the VCT phase control to the lock pin projection control, the foreign object release control means determines that the abnormality of a lock occurs, and the foreign object release control means executes the foreign object release control by executing both of the followings:

the foreign object release control means sets a variable range of the control amount of the hydraulic control valve such that the variable range of the control amount covers the control range of the VCT phase control and the control range of the lock mode; and the foreign object release control means sets an initial value of the control amount of the hydraulic control valve during a start of the foreign object release control at a limit value of the control range of the VCT phase control.

9. The variable valve timing control apparatus according to claim 8, wherein:

the foreign object release control means is prohibited from executing the foreign object release control in the execution of the foreign object release control when an operational state changes to a state that is different from a lock request condition.

10. The variable valve timing control apparatus according to claim 2, wherein:

when the lock pin has not been retracted even after a predetermined period has elapsed since the control is switched from the lock pin projection control to a pin retraction control for retracting the lock pin, the foreign object release control means determines that the abnormality of a lock release occurs and executes the foreign object release control by executing both of the followings:

the foreign object release control means sets a variable range of the control amount of the hydraulic control valve such that the variable range of the control amount covers the control range of the lock mode and the control range of the VCT phase control; and the foreign object release control means sets an initial value of the control amount of the hydraulic control valve during a start of the foreign object release control at a control value other than both of limit values of the variable range.

11. The variable valve timing control apparatus according to claim 10, wherein:

the foreign object release control means is prohibited from executing the foreign object release control in the execution of the foreign object release control when one of the followings is satisfied:

the operational state changes to a state that is different from a lock-release-request condition; and the VCT phase is shifted form the intermediate lock position.

12. The variable valve timing control apparatus according to claim 2, wherein:

when the VCT phase becomes incapable of following the target phase during the VCT phase control, the foreign object release control means determines that the abnormality of the VCT phase control occurs, and executes the foreign object release control by executing both of the followings:

the foreign object release control means sets a variable range of the control amount of the hydraulic control valve within the control range of the VCT phase control; and the foreign object release control means sets an initial value of the control amount of the hydraulic control valve during a start of the foreign object release control at a control value within the variable range, at which value the VCT phase is shifted toward the target phase at a maximum speed.

13. The variable valve timing control apparatus according to claim 2, wherein:

the foreign object release control means executes both of the followings in the execution of the foreign object release control:

the foreign object release control means periodically changes the control amount of the hydraulic control valve between a plurality of control values; and a pulse duration, during which the control amount is at one of the plurality of control values for shifting the VCT phase in a wanted direction, which is determined based on the operational state, or which is determined to prevent the operational state from deteriorating, is made longer than a pulse duration, during which the control amount is at the other one of the plurality of control values.

14. The variable valve timing control apparatus according to claim 2, wherein:

the VCT control means executes, upon generation of a lock request, a lock trial control, in which the VCT phase is temporarily shifted in a first direction to pass the intermediate lock position by a predetermined passing amount and then the VCT control means executes the lock pin projection control in order to lock the VCT phase by the lock pin while the VCT phase is shifted in a second direction opposite from the first direction back to the intermediate lock position;

when the lock of the VCT phase has not been completed after the lock pin projection control has been executed for a predetermined period, the predetermined passing amount is adjusted, and the lock trial control is repeated until the lock is completed; and when the lock of the VCT phase has not been completed even after a number of times of executing the lock trial control reaches a predetermined number of times, the foreign object release control means determines that the abnormality of a lock occurs and executes the foreign object release control.

15. A variable valve timing control apparatus for an internal combustion engine that has:

a crankshaft;

a camshaft;

a hydraulic variable valve timing unit configured to adjust valve timing by changing a variable cam timing (VCT) phase that is a rotational phase of the camshaft relative to the crankshaft;

a lock pin configured to lock the VCT phase at an intermediate lock position located within an adjustable range of the VCT phase; and a hydraulic control valve configured to control oil pressure that actuates the variable valve timing unit and the lock pin, the variable valve timing control apparatus comprising:

VCT control means for switching a control, based on an operational state, between (a) a VCT phase control for controlling the VCT phase to a target phase and (b) a lock pin projection control for allowing the lock pin to project; and foreign object release control means for executing, when an abnormality occurs, a foreign object release control for changing a control amount of the hydraulic control valve based on a predetermined pattern, wherein:

the VCT control means executes, upon generation of a lock request, a lock trial control, in which the VCT phase is temporarily shifted in a first direction to pass the intermediate lock position by a predetermined passing amount and then the VCT control means executes the lock pin projection control in order to lock the VCT phase by the lock pin while the VCT phase is shifted in a second direction opposite from the first direction back to the intermediate lock position;

when the lock of the VCT phase has not been completed after the lock pin projection control has been executed for a predetermined period, the predetermined passing amount is adjusted, and the lock trial control is repeated until the lock is completed; and when the lock of the VCT phase has not been completed even after a number of times of executing the lock trial control reaches a predetermined number of times, the foreign object release control means determines that the abnormality of a lock occurs and executes the foreign object release control.

16. The variable valve timing control apparatus according to claim 15, wherein:

the foreign object release control means further executes the lock trial control once or more after the foreign object release control means executes the foreign object release control for a predetermined period;

the foreign object release control means determines that failure occurs and provides warning of the failure through warning means when the lock of the VCT phase has not been completed even after the further execution of the lock trial control; and the VCT control means executes the VCT phase control to control the VCT phase to one of the intermediate lock position, a full retard position, and a full advance position when the lock request occurs after the warning of the failure is provided through the warning means.

17. The variable valve timing control apparatus according to claim 15, further comprising:

reference phase learning means for learning a reference phase of the VCT phase control;

the foreign object release control means further executes the lock trial control once or more after the foreign object release control means executes the foreign object release control for a predetermined period;

after the execution of the foreign object release control for the predetermined period, the foreign object release control means causes the reference phase learning means to learn the reference phase and initializes a learning value of the reference phase;

after the learning of the reference phase and the initialization of the learning value of the reference phase, the foreign object release control means further executes the lock pin projection control;

when the lock has not been completed even after the further execution of the lock pin projection control, the foreign object release control means determines that failure occurs, and provides warning of the failure through warning means; and the VCT control means controls the VCT phase to one of the intermediate lock position, a full retard position, and a full advance position by the VCT phase control when the lock request is generated after the warning of the failure is provided through the warning means.

18. The variable valve timing control apparatus according to claim 15, wherein:

the internal combustion engine includes a plurality of cylinder groups;

the variable valve timing unit is one of a plurality of variable valve timing units;

each of the plurality of variable valve timing units is provided to a corresponding one of the plurality of cylinder groups;

when it is determined that the failure occurs to one of the plurality of cylinder groups, the foreign object release control means executes a certain control, which is determined based on the failure, to the one of the plurality of cylinder groups; and the foreign object release control means executes the certain control to the other one of the plurality of cylinder groups.

19. The variable valve timing control apparatus according to claim 15, wherein:

the VCT control means executes a lock release control when a lock release request is generated;

the lock release control includes:

a pin retraction control, in which the lock pin is retracted in a lock release direction while a driving force for shifting the VCT phase in an advance direction or in a retard direction is regulated to be equal to or less than a predetermined value; and the VCT phase control that is executed after the pin retraction control has been executed for a predetermined period;

the VCT control means further executes the lock release control once or more when the VCT phase has not been shifted from the intermediate lock position after the VCT phase control has been executed for a predetermined period; and the foreign object release control means determines that the abnormality of a lock release occurs and executes the foreign object release control when the VCT phase has still not been shifted from the intermediate lock position even after the further execution of the lock release control.

20. The variable valve timing control apparatus according to claim 19, wherein:

the VCT control means further executes the lock release control once or more after the foreign object release control means executes the foreign object release control for a predetermined period;

when the VCT phase has still not been shifted from the intermediate lock position after the further execution of the lock release control, the foreign object release control means determines that failure occurs and provides warning of the failure through warning means; and the VCT control means sets the control amount of the hydraulic control valve within the control range of the lock pin projection control under all operational conditions after the warning of the failure is provided through the warning means.

21. The variable valve timing control apparatus according to claim 19, wherein:

after the foreign object release control means executes the foreign object release control for a predetermined period, the VCT control means further executes the lock release control once or more by changing at least one of the control amount and an execution period of the pin retraction control;

when the VCT phase has still not been shifted from the intermediate lock position even after the further execution of the lock release control, the foreign object release control means determines that failure occurs and provides warning of the failure through warning means; and the VCT control means sets the control amount of the hydraulic control valve within the control range of the lock pin projection control under all operational conditions after the warning of the failure is provided through the warning means.

22. The variable valve timing control apparatus according to claim 19, wherein:

the internal combustion engine includes a plurality of cylinder groups;

the variable valve timing unit is one of a plurality of variable valve timing units;

each of the plurality of variable valve timing units is provided to a corresponding one of the plurality of cylinder groups;

when it is determined that the failure occurs to one of the plurality of cylinder groups, the foreign object release control means executes a certain control, which is determined based on the failure, to the one of the plurality of cylinder groups; and the foreign object release control means executes the certain control to the other one of the plurality of cylinder groups.

23. The variable valve timing control apparatus according to claim 15, wherein:

the hydraulic control valve integrally includes first means for controlling oil pressure that actuates the VCT phase and second means for controlling oil pressure that actuates the lock pin;

the hydraulic control valve is operated under the following control modes based on the control amount of the hydraulic control valve:

a retard operation mode, in which the hydraulic control valve causes the VCT phase to be shifted in a retard direction;

a hold mode, in which the hydraulic control valve causes the VCT phase to be held;

an advance operation mode, in which the hydraulic control valve causes the VCT phase to be shifted in an advance direction; and a lock mode, in which the hydraulic control valve allows the lock pin to project in a lock direction;

in the execution of the VCT phase control, the VCT control means controls the VCT phase to the target phase based on the control amount within a control range that includes a control range of the retard operation mode, a control range of the hold mode, and a control range of the advance operation mode; and in the execution of the lock pin projection control, the VCT control means allows the lock pin to project based on the control amount within a control range of the lock mode.

24. A variable valve timing control apparatus for an internal combustion engine that has:

a crankshaft;

a camshaft;

a hydraulic variable valve timing unit configured to adjust valve timing by changing a variable cam timing (VCT) phase that is a rotational phase of the camshaft relative to the crankshaft;

a lock pin configured to lock the VCT phase at an intermediate lock position located within an adjustable range of the VCT phase; and a hydraulic control valve configured to control oil pressure that actuates the variable valve timing unit and the lock pin, the variable valve timing control apparatus comprising:

VCT control means for switching a control, based on an operational state, between (a) a VCT phase control for controlling the VCT phase to a target phase and (b) a lock pin projection control for allowing the lock pin to project; and foreign object release control means for executing, when an abnormality occurs, a foreign object release control for changing a control amount of the hydraulic control valve based on a predetermined pattern, wherein:

the VCT control means executes a lock release control when a lock release request is generated;

the lock release control includes:

a pin retraction control, in which the lock pin is retracted in a lock release direction while a driving force for shifting the VCT phase in an advance direction or in a retard direction is regulated to be equal to or less than a predetermined value; and the VCT phase control that is executed after the pin retraction control has been executed for a predetermined period;

the VCT control means further executes the lock release control once or more when the VCT phase has not been shifted from the intermediate lock position after the VCT phase control has been executed for a predetermined period; and the foreign object release control means determines that the abnormality of a lock release occurs and executes the foreign object release control when the VCT phase has still not been shifted from the intermediate lock position even after the further execution of the lock release control.

25. The variable valve timing control apparatus according to claim 24, wherein:

the VCT control means further executes the lock release control once or more after the foreign object release control means executes the foreign object release control for a predetermined period;

when the VCT phase has still not been shifted from the intermediate lock position after the further execution of the lock release control, the foreign object release control means determines that failure occurs and provides warning of the failure through warning means; and the VCT control means sets the control amount of the hydraulic control valve within the control range of the lock pin projection control under all operational conditions after the warning of the failure is provided through the warning means.

26. The variable valve timing control apparatus according to claim 24, wherein:

after the foreign object release control means executes the foreign object release control for a predetermined period, the VCT control means further executes the lock release control once or more by changing at least one of the control amount and an execution period of the pin retraction control;

when the VCT phase has still not been shifted from the intermediate lock position even after the further execution of the lock release control, the foreign object release control means determines that failure occurs and provides warning of the failure through warning means; and the VCT control means sets the control amount of the hydraulic control valve within the control range of the lock pin projection control under all operational conditions after the warning of the failure is provided through the warning means.

27. The variable valve timing control apparatus according to claim 24, wherein:

the internal combustion engine includes a plurality of cylinder groups;

the variable valve timing unit is one of a plurality of variable valve timing units;

each of the plurality of variable valve timing units is provided to a corresponding one of the plurality of cylinder groups;

when it is determined that the failure occurs to one of the plurality of cylinder groups, the foreign object release control means executes a certain control, which is determined based on the failure, to the one of the plurality of cylinder groups; and the foreign object release control means executes the certain control to the other one of the plurality of cylinder groups.

28. The variable valve timing control apparatus according to claim 24, wherein:

the hydraulic control valve integrally includes first means for controlling oil pressure that actuates the VCT phase and second means for controlling oil pressure that actuates the lock pin;

the hydraulic control valve is operated under the following control modes based on the control amount of the hydraulic control valve:

a retard operation mode, in which the hydraulic control valve causes the VCT phase to be shifted in a retard direction;

a hold mode, in which the hydraulic control valve causes the VCT phase to be held;

an advance operation mode, in which the hydraulic control valve causes the VCT phase to be shifted in an advance direction; and a lock mode, in which the hydraulic control valve allows the lock pin to project in a lock direction;

in the execution of the VCT phase control, the VCT control means controls the VCT phase to the target phase based on the control amount within a control range that includes a control range of the retard operation mode, a control range of the hold mode, and a control range of the advance operation mode; and in the execution of the lock pin projection control, the VCT control means allows the lock pin to project based on the control amount within a control range of the lock mode.

* * * * *